US007484906B2

(12) United States Patent
La Turner et al.

(10) Patent No.: US 7,484,906 B2
(45) Date of Patent: Feb. 3, 2009

(54) CRASH CUSHION

(75) Inventors: John F. La Turner, Carmichael, CA (US); Michael H. Oberth, Lincoln, CA (US); Douglas E. Wilkinson, Auburn, CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 0 days.

(21) Appl. No.: 11/950,066

(22) Filed: Dec. 4, 2007

(65) Prior Publication Data

US 2008/0085153 A1 Apr. 10, 2008

Related U.S. Application Data

(63) Continuation of application No. 11/223,471, filed on Sep. 8, 2005.

(60) Provisional application No. 60/666,758, filed on Mar. 30, 2005, provisional application No. 60/610,104, filed on Sep. 15, 2004.

(51) Int. Cl.
*E01F 13/00* (2006.01)
*E01F 15/00* (2006.01)

(52) U.S. Cl. ..... 404/6; 404/9; 404/10; 256/13.1; 49/49

(58) Field of Classification Search ..... 404/6, 404/9, 10; 256/13.1; 49/49
See application file for complete search history.

(56) References Cited

U.S. PATENT DOCUMENTS 1,511,264 A 10/1924 Carter
2,391,275 A 12/1945 Shaw
2,483,655 A 10/1949 Schultz
2,578,903 A 12/1951 Smith (Continued)

FOREIGN PATENT DOCUMENTS

EP 0 042 645 A2 12/1981

(Continued)

OTHER PUBLICATIONS

M. H. Ray et al., "Side Impact Crash Testing", Report FHWA-RD-92-052, Test No. 91S046, Mar. 1992, Federal Highway Admin., McLean, VA., pp. 1-34.

(Continued)

*Primary Examiner*—Raymond W Addie
(74) *Attorney, Agent, or Firm*—Brinks Hofer Gilson & Lione

(57) ABSTRACT

A vehicle crash cushion for decelerating a vehicle includes first, second and third bays. The first bay is positioned forwardly of the second bay and the second bay is positioned forwardly of the third bay. The first, second and third bays each have energy absorbing structures with first, second and third impact strengths respectively. The first impact strength is greater than the third impact strength, which is greater than the second impact strength. In another aspect, a deformable tube is at least partially filled with a secondary component, which filled portion has a greater deformation strength than unfilled portions of the tube. In another aspect, a vehicle crash cushion includes first and second side panels. A connector includes a first strap portion disposed in a valley of and connected to the first side panel and a second strap portion disposed adjacent to and connected to a ridge of the second side panel.

20 Claims, 25 Drawing Sheets

U.S. PATENT DOCUMENTS

| | | | | |
|---|---|---|---|---|
| 2,870,871 | A | 1/1959 | Stevinson | |
| 2,979,163 | A | 4/1961 | Van Zelm et al. | |
| 2,980,213 | A | 4/1961 | Van Zelm et al. | |
| 3,017,163 | A | 1/1962 | Van Zelm et al. | |
| 3,087,584 | A | 4/1963 | Jackson et al. | |
| 3,132,721 | A | 5/1964 | Jackson | |
| 3,143,321 | A | 8/1964 | McGehee et al. | |
| 3,146,014 | A | 8/1964 | Kroell | |
| 3,181,821 | A | 5/1965 | Webb | |
| 3,195,685 | A | 7/1965 | Blackstone | |
| 3,211,260 | A | 10/1965 | Jackson | |
| 3,236,333 | A | 2/1966 | Mitchell | |
| 3,307,832 | A | 3/1967 | Van Zelm et al. | |
| 3,308,908 | A | 3/1967 | Bunn | |
| 3,337,004 | A | 8/1967 | Hoffman et al. | |
| 3,372,773 | A | 3/1968 | Russo et al. | |
| 3,377,044 | A | 4/1968 | Jackson et al. | |
| 3,486,791 | A | 12/1969 | Stoffel et al. | |
| 3,547,468 | A | 12/1970 | Giuffrida | |
| 3,561,690 | A | 2/1971 | Muskat | |
| 3,604,285 | A | 9/1971 | Olsson | |
| 3,674,115 | A | 7/1972 | Young et al. | |
| 3,719,255 | A | 3/1973 | Daniels et al. | |
| 3,730,586 | A | 5/1973 | Eggert | |
| 3,768,781 | A | 10/1973 | Walker et al. | |
| 3,820,634 | A | 6/1974 | Poe | |
| 3,944,187 | A | 3/1976 | Walker | |
| 3,968,863 | A | 7/1976 | Reilly | |
| 3,982,734 | A | 9/1976 | Walker | |
| 4,027,905 | A | 6/1977 | Shimogawa et al. | |
| 4,150,805 | A | 4/1979 | Mazelsky | |
| 4,200,310 | A | 4/1980 | Carney | |
| 4,223,763 | A | 9/1980 | Duclos et al. | |
| 4,289,419 | A | 9/1981 | Young et al. | |
| 4,358,136 | A | 11/1982 | Tsuge et al. | |
| 4,399,980 | A | 8/1983 | van Schie | |
| 4,452,431 | A | 6/1984 | Stephens et al. | |
| 4,583,716 | A | 4/1986 | Stephens et al. | |
| 4,630,716 | A | 12/1986 | Faust | |
| 4,784,515 | A | 11/1988 | Krage et al. | |
| 4,815,565 | A | 3/1989 | Sicking et al. | |
| 4,844,213 | A | 7/1989 | Travis | |
| 4,928,928 | A | 5/1990 | Buth et al. | |
| 5,022,782 | A | 6/1991 | Gertz et al. | |
| 5,074,391 | A | 12/1991 | Rosenzweig | |
| 5,078,366 | A | 1/1992 | Sicking et al. | |
| 5,193,764 | A * | 3/1993 | Larratt et al. | 244/110 R |
| 5,391,016 | A | 2/1995 | Ivey et al. | |
| 5,487,562 | A | 1/1996 | Hedderly et al. | |
| 5,597,055 | A | 1/1997 | Han et al. | |
| 5,634,738 | A | 6/1997 | Jackson et al. | |
| 5,775,675 | A | 7/1998 | Sicking et al. | |
| 5,791,812 | A | 8/1998 | Ivey | |
| 5,797,591 | A | 8/1998 | Krage | |
| 5,902,068 | A * | 5/1999 | Angley et al. | 404/34 |
| 5,924,680 | A | 7/1999 | Sicking et al. | |
| 5,947,452 | A | 9/1999 | Albritton | |
| 6,004,066 | A * | 12/1999 | Niemerski | 404/6 |
| 6,024,383 | A | 2/2000 | Fohl | |
| 6,082,926 | A | 7/2000 | Zimmer | |
| 6,109,597 | A | 8/2000 | Sicking et al. | |
| 6,179,516 | B1 * | 1/2001 | Ivey et al. | 404/6 |
| 6,203,079 | B1 * | 3/2001 | Breed | 293/119 |
| 6,293,205 | B1 * | 9/2001 | Butler | 105/392.5 |
| 6,293,727 | B1 | 9/2001 | Albritton | |
| 6,308,309 | B1 | 10/2001 | Gan et al. | |
| 6,308,809 | B1 | 10/2001 | Reid et al. | |
| 6,394,241 | B1 | 5/2002 | Pesjardins et al. | |
| 6,457,570 | B2 | 10/2002 | Reid et al. | |
| 6,536,985 | B2 | 3/2003 | Albritton et al. | |
| 6,668,989 | B2 | 12/2003 | Reid et al. | |
| 6,719,483 | B1 | 4/2004 | Welandsson | |
| 6,962,245 | B2 | 11/2005 | Ray et al. | |
| 7,185,882 | B2 | 3/2007 | Buth et al. | |
| 2003/0175076 | A1 | 9/2003 | Albritton | |
| 2004/0141808 | A1 * | 7/2004 | Allen et al. | 404/10 |
| 2007/0682442 | | 6/2007 | Buth | |

FOREIGN PATENT DOCUMENTS

| | | | |
|---|---|---|---|
| EP | 0 286 782 | A1 | 10/1988 |
| WO | WO 97/47495 | A1 | 12/1997 |
| WO | WO 98/44203 | | 10/1998 |
| WO | WO 00/68594 | A1 | 11/2000 |
| WO | WO 03/102402 | A2 | 12/2003 |

OTHER PUBLICATIONS

M. H. Ray et al., "Side Impact Crash Test and Evaluation Procedures for Roadside Structure Crash Test", Report FHWA-RD-92-062, May 1993, Fed. Hwy. Admin., McLean, VA., pp. 1-28.

M. H. Ray et al., "Side Impact Crash Testing of Roadside Structures", Report FHWA-RD-92-079, May 1993, Fed. Hwy. Admin., McLean, VA., pp. 1-78.

M. H. Ray et al., "Severity Measures in Side-Impacts with Narrow Roadside Structures", J. Transportation Eng., 120(2):322-338, Mar.-Apr. 1994.

M. H. Ray et al., "Test and Evaluation Criteria for Side-Impact Roadside Appurtenance Collisions", J. Transportation Eng., 120(4):633-651, Jul.-Aug. 1994.

M. H. Ray et al., "Side Impact Crash Test and Evaluation Criteria for Roadside Safety Hardware", General Design and Roadside Safety Features, Transportation Research Record No. 1647, T.R.B., Washington, D.C., pp. 1-17, Jan. 1998.

M. H. Ray et al., "Evaluating Human Risk in Side Impact Collisions with Roadside Objects", Paper No. 00-0250, Transportation Research Board 79th Annual Meeting, Washington, DC, Jan. 9-13, 2000, pp. 1-16.

B. G. Pfeifer et al., "Development of a Metal Cutting W-Beam Guardrail Terminal", Transportation Research Report TRP-03-43-94, Sep. 1994, Fed. Hwy. Admin., 57 pages.

Road Systems, Inc.—BEAT & BEAT-MT, "BEAT Box Beam Bursting Energy Absorbing Terminals", obtained at the internet address http://www.roadsystems.com/beat.htm, 2 pages, Jan. 2004.

Road Systems, Inc.—FLEAT, "How the FLEAT Functions" obtained at the internet address http://www.roadsystems.com/fleat.htm, 2 pages, Jan. 2004.

Road Systems, Inc.—SKT, "How the SKT Functions" obtained at the internet address http://www.roadsystems.com/skt.htm, 2 pages, Jan. 2004.

Road Systems, Inc.—FLEAT-MT, "How the FLEAT-MT Functions" obtained at the internet address http://www.roadsystems.com/fleatmt.htm, 1 page, Jan. 2004.

Trinity Industries, Inc., "Products-Taking Highway Safety Into the 21st Century!, TRACC Family", obtained at the internet address http://www.highwayguardrail.com/Products%20-%20TRACC%20FAMILY.html 4 pages, Jan. 2004.

* cited by examiner 56
112
96
28
52
46
32
52
50
114
102
114
42
40
36
44
48
30
40
52
34
52
50
104
114
102
114
38
44
4
112
78
74
72
70
76

CRASH CUSHION

This application is a continuation of U.S. application Ser. No. 11/223,471, filed Sep. 8, 2005, which application claims the benefit of U.S. Provisional Application No. 60/666,758, filed Mar. 30, 2005 and U.S. Provisional Application No. 60/610,104, filed Sep. 15, 2004, the entire disclosures of which are hereby incorporated herein by reference.

BACKGROUND

This invention relates to an improved vehicle crash cushion for decelerating and redirecting a vehicle, for example a vehicle that has left a roadway.

Crash cushions are commonly employed alongside roadways to stop a vehicle, which has left the roadway, in a controlled manner while limiting the maximum deceleration to which the occupants of the vehicle are subjected. Non-gating or redirective crash cushions have sufficient strength to redirect a laterally impacting vehicle when struck from the side in a lateral impact. One criteria for measuring the capabilities of a crash cushion is the crash test specification-n NCHRP 350. Under the tests in this specification, an occupant of both light and heavy vehicles must experience less than a 12 m/s change in velocity (delta (Δ) V) upon contacting the vehicle interior and less than a 20 g deceleration after contact.

Often, in non-gating/redirecting types of crash cushions, the structure that absorbs energy in an axial impact does not also function to redirect a vehicle impacting the side of the system. Accordingly, additional structures must be provided to resist the lateral impact, for example fender panels, as well as to anchor or resist lateral movement, for example cables or tracks. Such multiple assembly structures can be expensive to make and time consuming to install.

In addition, many of these systems are not bi-directional, meaning they do not adequately redirect vehicles striking the crash cushion on opposite sides when traveling in opposite directions.

One crash cushion shown in U.S. Pat. No. 3,674,115 to Young, assigned to Energy Absorption Systems, Inc., the assignee of the present invention, includes a frame made up of an axially oriented array of segments, each having a diaphragm extending transverse to the axial direction and a pair of side panels positioned to extend rearwardly from the diaphragm. Energy absorbing elements (in this example water filled flexible cylindrical elements) are mounted between the diaphragms. During an axial impact the diaphragms deform the energy absorbing elements, thereby causing water to be accelerated to absorb the kinetic energy of the impacting vehicle. Axially oriented cables are positioned on each side of the diaphragms to maintain the diaphragms in axial alignment during an impact.

U.S. Pat. No. 3,944,187 and U.S. Pat. No. 3,982,734 to Walker, both assigned to Energy Absorption Systems, Inc., the assignee of this invention, also include a collapsible frame made up of an axially oriented array of diaphragms with side panels mounted to the diaphragms that slide over one another during an axial collapse. Energy absorbing cartridges perform the energy absorption function, while obliquely oriented cables are provided between the diaphragms and ground anchors to maintain the diaphragms in axial alignment during a lateral impact.

U.S. Pat. No. 4,452,431 to Stephens, also assigned to Energy Absorption Systems, Inc., the assignee of the present invention, shows yet another collapsible crash barrier employing diaphragms and side panels generally similar to those described above. This system also uses axially oriented cables to maintain the diaphragms in axial alignment, as well as breakaway cables secured between the front diaphragm and the ground anchor. These breakaway cables are provided with shear pins designed to fail during an axial impact to allow the frame to collapse.

U.S. Pat. No. 4,399,980 to VanSchie discloses another crash barrier which employs cylindrical tubes oriented axially between adjacent diaphragms. The energy required to deform these tubes during an axial collapse provides a force tending to decelerate the impacting vehicle. Cross-braces are used to stiffen the frame against lateral impacts, and a guide is provided for the front of the frame to prevent the front of the frame from moving laterally when the frame is struck in a glancing impact by an impacting vehicle.

In yet another system, shown in U.S. Pat. No. 6,293,727, the crash cushion includes frames connected with side panels, and an energy absorbing device that includes a cutter that cuts through a metal plate. A sled is supported by guide rails, which resist lateral impacts.

All of these prior art systems are designed to absorb the kinetic energy of the impacting vehicle by deforming an energy absorbing structure. These systems use additional structural members that resist side forces.

U.S. Pat. No. 5,022,782 to Gertz et al., also assigned to Energy Absorption Systems, Inc., the assignee of the present application, shows another crash barrier using a friction brake to dissipate energy. The system also includes peel straps connecting fender panels, with the peel straps absorbing energy during a collision.

Another system is shown in PCT Application WO 03/102402A2, which discloses a crash cushion using an adjustable array of pins to deform strips or tubes to dissipate energy. The energy required to deform the strips or tubes results in a kinetic energy dissipating force which decelerates the impacting vehicle. The system pushes the array of pins along the strips or tubes, and the strips and/or tubes do not provide redirective capabilities. Other systems showing the principle of deforming metal to absorb energy are shown for example in U.S. Pat. No. 4,223,763, to Duclos et al. and U.S. Pat. No. 3,087,584 to Jackson.

Another system is shown in U.S. Pat. No. 6,719,483 to Welandson, which discloses a forming device that deforms a crash barrier girder. The girder is secured to post members that are not moveable, but rather are anchored in the ground.

Thus, a need presently exists for an improved highway crash barrier that provides predictable decelerating forces to an axially impacting vehicle, that is low in cost, that is simple to install, that minimizes the structure required to resist lateral impacts, that is bi-directional and that efficiently redirects laterally impacting vehicles.

SUMMARY

In one aspect, a vehicle crash cushion for decelerating and redirecting a vehicle includes front and rear anchors spaced along a longitudinal direction and at least one deformable attenuator member extending in the longitudinal direction and having a first end coupled to the front anchor and a second end coupled to the rear anchor. A support member is positioned adjacent the attenuator member and is moveable in the longitudinal direction relative thereto between at least an initial position and an impact position toward the rear anchor and away from the front anchor. The support member has a front side facing the front anchor and a back side facing the rear anchor. At least one deforming member is mounted on the support member. The deforming member is disposed around and engaged with at least a portion of the attenuator member on the front side of the support member. The attenuator is at least partially deformed by engagement with the deforming member. The deforming member is pulled by the support member along the attenuator member as the support member is moved in the longitudinal direction relative to the attenuator member from the initial position to the impact position.

In another aspect, a vehicle crash cushion for decelerating a vehicle includes front and rear anchors spaced along a longitudinal direction and a plurality of support members each having opposite sides, with at least some of the support members being moveable in the longitudinal direction. At least one side panel is connected to one of the sides of one of the support members. The side panel includes a first outer impact surface adapted to be exposed to an impacting vehicle. At least one deformable attenuator member extends in the longitudinal direction and is disposed adjacent the side of the support members below the side panel. The attenuator member defines a second outer impact surface adapted to be exposed to the impacting vehicle. The attenuator member has a first end coupled to the front anchor and a second end coupled to the rear anchor. At least one deforming member is connected to at least one of the support members and is engaged with at least a portion of the attenuator member.

In one embodiment, the crash cushion further includes an auxiliary attenuator member that is moved relative to an auxiliary deforming member. In one embodiment, a backup structure forms the rear anchor and includes a side panel shaped and positioned to mate with a side panel extending forwardly therefrom. The backup structure is fixedly secured to the ground and is self-anchored. Also in one embodiment, at least a portion of the attenuator member is crimped or preformed such that the deforming member is not required to deform the attenuator member as it is moved along the crimped portion. In this way, the system can be tuned to dissipate more or less energy.

In yet another aspect, a vehicle crash cushion for decelerating a vehicle includes a plurality of support members at least some of which are moveable in a longitudinal direction from an initial position to an impact position. The support members are spaced apart in the longitudinal direction and define at least in part first, second and third bays between respective pairs of support members when the support members are in the initial condition. The first bay is positioned forwardly of the second bay and the second bay is positioned forwardly of the third bay. The first, second and third bays include first, second and third energy absorbing structures respectively, each having first, second and third impact strengths respectively. The first impact strength is greater than the second and third impact strengths and the third impact strength is greater than the second impact strength. The second, third and first bays are collapsible in sequential order as respective support members defining at least in part each of the second, third and first bays are moved in the longitudinal direction from the initial condition to the impact position. A method of decelerating a vehicle with the crash cushion includes impacting the crash cushion and sequentially collapsing the second, third and first bays.

In yet another aspect, a crash cushion includes a deformable tube extending in a longitudinal direction and having first and second ends. A deforming member includes a housing and at least one plate member connected to the housing. The deforming member is moveable along the tube in the longitudinal direction away from the first end and toward the second end. The plate includes an impact surface having a leading portion and a trailing portion. The leading portion is positioned closer to the second end of the tube than the trailing portion. The impact surface is angled between the leading and trailing portions with the impact surface at the trailing portion impinging on the tube a greater amount than the impact surface at the leading portion.

In yet another aspect, a vehicle crash cushion includes an elongated frame having a plurality of sections including at least a first and second section arranged end to end along a longitudinal direction. The first and second frame sections include first and second side panels respectively. Each of the side panels includes at least one longitudinally extending ridge and at least one longitudinally extending valley. The first side panel is moveable relative to the second side panel in response to an axial force being applied to the elongated frame. A connector includes at least one first strap portion disposed in the valley of and connected to the first side panel and at least one second strap portion disposed adjacent to and connected to at least one ridge of the second side panel. The first and second strap portions lie in first and second laterally offset planes respectively. In one embodiment, a pair of first strap portions are disposed in adjacent valleys and are connected to a vertical portion of the second strap portion, which further includes a horizontal portion connected to the ridge of the second panel. In various embodiments, the second strap portion is T-shaped, and can include a relief formed along a top thereof.

A method of decelerating a vehicle with the crash cushion includes impacting the crash cushion in an axial direction, moving the first side panel relative to the second side panel in response thereto, and progressively disconnecting the first strap portion from the first side panel as the first side panel is moved relative to the second side panel.

In yet another aspect, a method of assembling a crash cushion includes providing a deformable first tube extending in a longitudinal direction and having first and second ends, with the first tube having at least one first opening formed therethrough. The method further includes disposing a second tube over the first tube, with the said second tube having at least one second opening formed therethrough. The method further includes aligning the first and second openings, inserting at least one plate member through the aligned first and second openings such that at least a portion of the plate member is disposed inside the first tube, and securing the plate member to the second tube.

The various aspects and embodiments provide significant advantages over other crash cushions. For example, and without limitation, in one embodiment the deforming member is pulled by the support member, rather than being pushed thereby. As such, the deforming member is less likely to bind upon the attenuator and the system therefore has a more predictable energy dissipation curve. In addition, in another aspect, the deforming member has few parts, is inexpensive to make and is robust in inclement weather. In addition, by providing aligned openings in the housing and attenuator tube, the deforming member plate can be easily installed without having to initially deform the attenuator tube. Moreover, the deforming member can be adjusted or tuned to provide more or less energy dissipation by varying the number, shape and degree of impingement of the plate member(s). Tuning also can be accomplished by varying the number of attenuators and/or the number of deforming members.

The attenuator can also be tuned by varying the shape, material and wall thickness of the tube, as well as by filling portions of the tube with other materials or by lubricating various portions of the tube. The attenuator can also be tuned along its length, so as to provide different deformation strengths downstream, for example by making it more difficult to deform as one moves downstream. In addition, the attenuator can act as a track or guide rail for other support members not configured with a deforming member. Rather, a guide connected to the support member travels along the attenuator and maintains the vertical position of the attenuator at a desired height.

In another aspect, the overall operation of the crash cushion also provides significant advantages. For example, the attenuator serves multiple functions. In particular, the attenuator dissipates energy in an axial impact through deformation. At the same time, the attenuator resists lateral impact and ties the system between the front and rear anchors. In addition, the attenuator, which is preferably exposed to an impacting vehicle, functions as a rub rail for lower portions of the vehicle, such as the tires, and helps to close the gap between the bottom of the side panels and the ground thereby reducing the likelihood that a tire or other portion of the vehicle can become snagged beneath the fender panel.

In addition, the connector member, with its strap portions, provides a mechanism for dissipating energy during an impact with minimal materials. By offsetting the strap portions between the valley and ridges, the connector pulls the connected side panels closer together when put in tension, for example during a lateral impact, thereby reducing the risk of snagging on the side panel. In addition, the side panels and connector function as a continuous belt or ribbon that absorbs the tension loading and redirects the errant vehicle. A tension member can be secured between one of the support members and the front anchor to further put the system in tension. The tension member acts as a trigger that releases upon a certain tension load being applied thereto during an impact. This ability to draw the side panels together works for bi-directional impacts, thereby making the system inherently bi-directional. The strap portions disposed in the valleys of the side panels further increase the torsional and bending stiffness of the side panels. In addition, separate reinforcement members can be secured in the valleys of the side panels to increase the bending and torsional stiffness thereof. The staggered locations of the strap connections further provides a mechanism for dissipating energy in controlled sequence that stabilizes the collapse. In addition, the system can be easily tuned by varying the shape (e.g. trapezoidal) and/or length of the straps and/or reinforcement members, the length and angle of the offset between the first and second strap portions, the amount of overhang, the length of the attachment locations and/or the frequency of the attachment locations.

In another aspect, the collapse sequence of the bays can provide various advantages. In particular, by configuring the energy absorbing mechanisms, including the attenuator, deforming member and strap configurations, with different impact strengths, the overall crash cushion can be configured to have a particular collapse sequence so as to maximize the efficiency for a range of impacting vehicle weights and speeds. For example, the second, or intermediate, bay can be configured to collapse first. In one embodiment, the second bay is also the longest and has sufficient dissipation capabilities for slowing the lightest weight vehicle through the initial change in velocity or delta V event, as well as absorbing all of the remaining light car energy after the delta V event. In this way, the light car's energy is absorbed by a single bay, such that no bay to bay transition effects will be experienced with the corresponding high deceleration spikes. After the second bay, the third (more rearward bay) collapses. Finally, the first (forward) bay collapses. In this way, the first bay collapse only at the end of an impact by the heaviest design vehicle. As such, the first bay acts as a sled, which resists rocking of the support members and further minimizes the stopping distance of lighter weight vehicles through momentum (mass) transfer. In addition, shorter, stiffer bays up front and in the rear help reduce the chance of pocketing, for example at the rear areas adjacent a fixed barrier.

In another embodiment, the first bay is made substantially rigid, with the second and third bays absorbing the energy in combination with one or more attenuator members, trigger members and/or peel straps. In other embodiments, the crash cushion is configured with four bays, including a rigid first bay and three collapsible bays. In one such embodiment, all four bays are substantially the same length.

The overall system is also highly portable, easy to install/replace and can be configured to protect a variety of highway hazards. The system can be transported in an assembled or disassembled configuration. In one embodiment, the system can be lifted, transported and dropped into position as an assembled unit. Moreover, the preferred materials of hot dipped galvanized welded and bolted steel parts are environmentally benign. The system also requires a minimal number of anchors at the ends of the device.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

The term "longitudinal" refers to the lengthwise direction 2 between the front and rear of a crash cushion 10, and is aligned with and defines an axial impact direction generally parallel to the arrow indicating traffic flow in FIGS. 1, 14, 32, 33 and 39. The term "front," "forward," "forwardly" and variations thereof refer to the position or orientation relative to the nose or proximal end 4 of the crash cushion initially impacted during an axial impact, while the term "rear," "rearward," "rearwardly" and variations thereof refer to the position or orientation relative to the tail or distal end 6 of the crash cushion located adjacent a roadside hazard. Therefore, for example, a component positioned forward of another component is closer to the nose or impact end, and vice versa a component positioned rearward of another component is closer to the tail or roadside hazard end.

Figure 1:
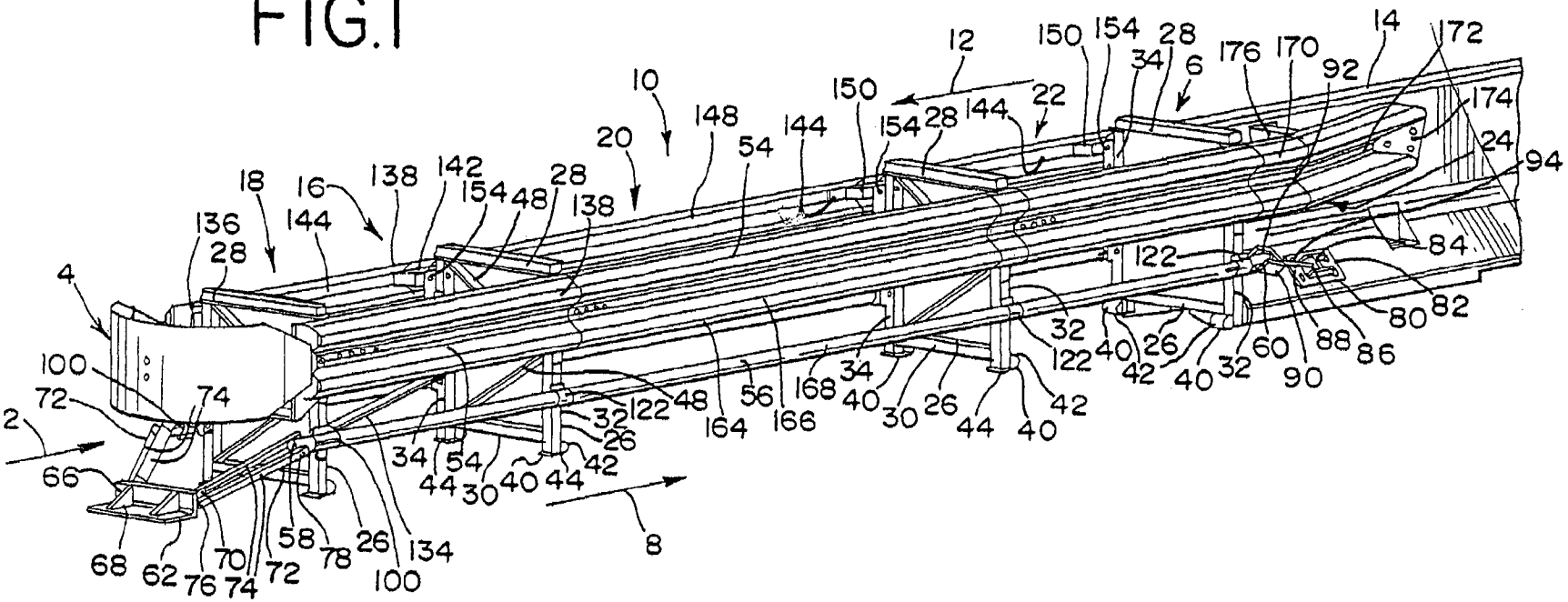
FIG. 1 is a perspective view of a first embodiment of a vehicle crash barrier in an initial condition.
Figure 14:
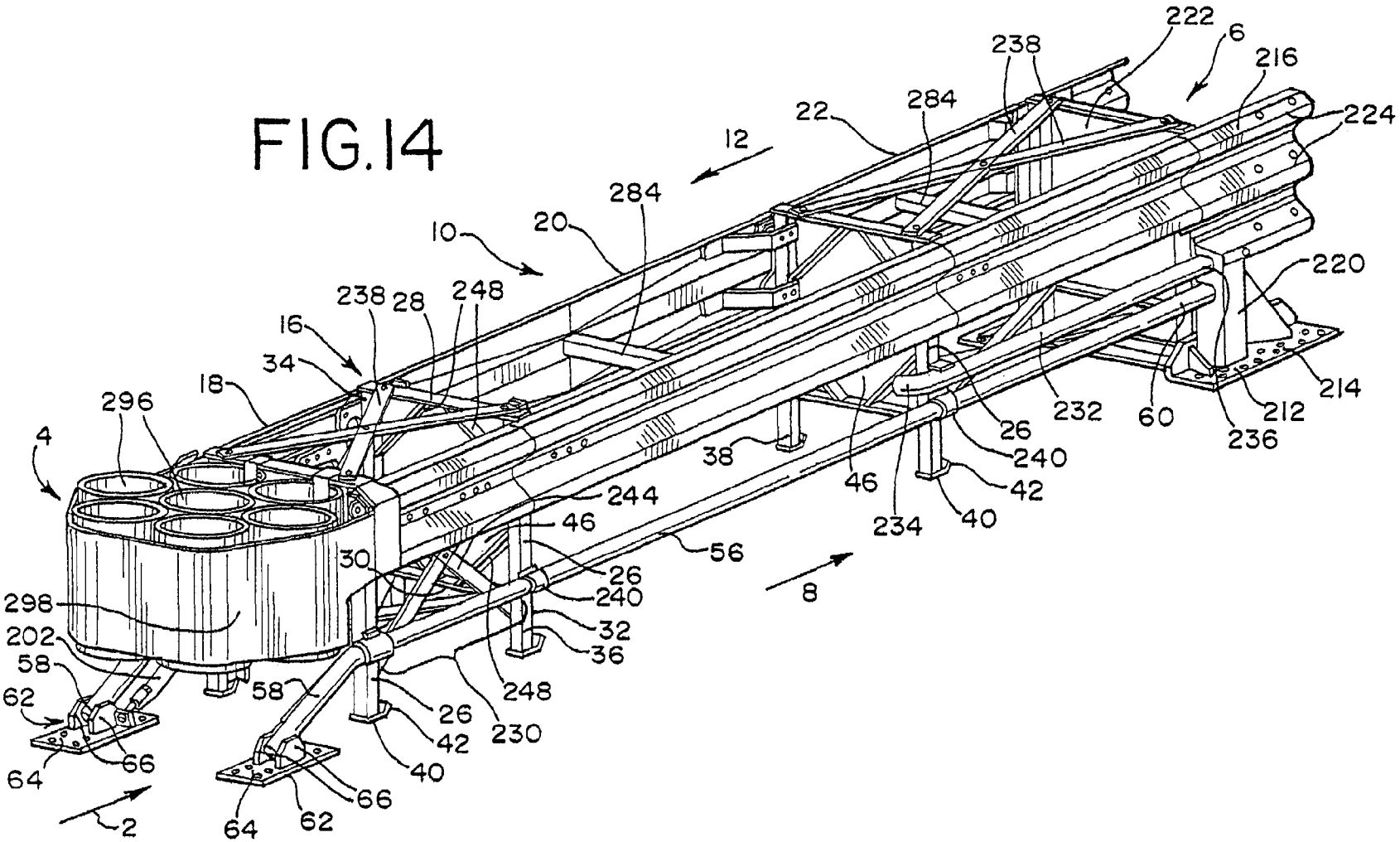
FIG. 14 is a perspective view of a second embodiment of a vehicle crash barrier in an initial condition.
Figure 32:
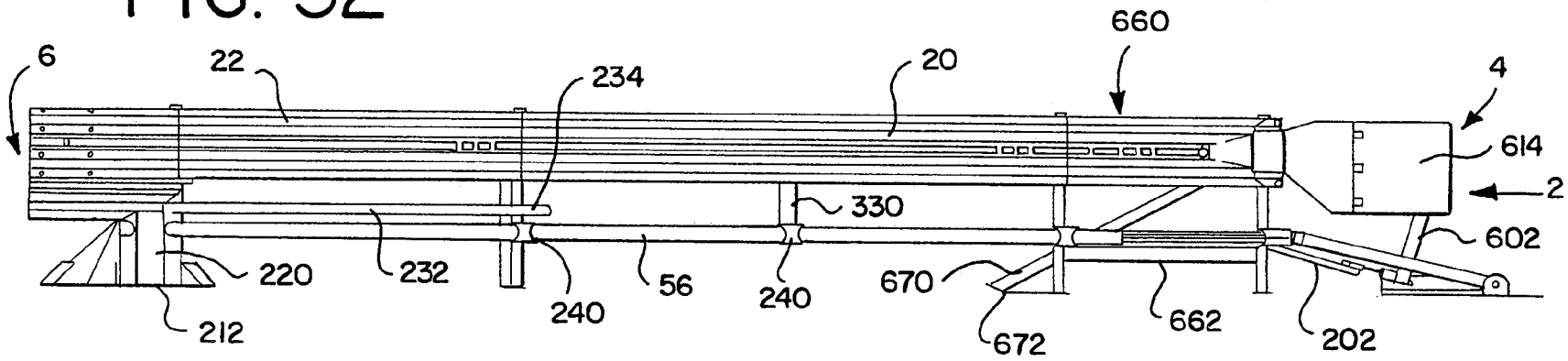
FIG. 32 is a side view of an alternative embodiment of a crash cushion.
Figure 33:
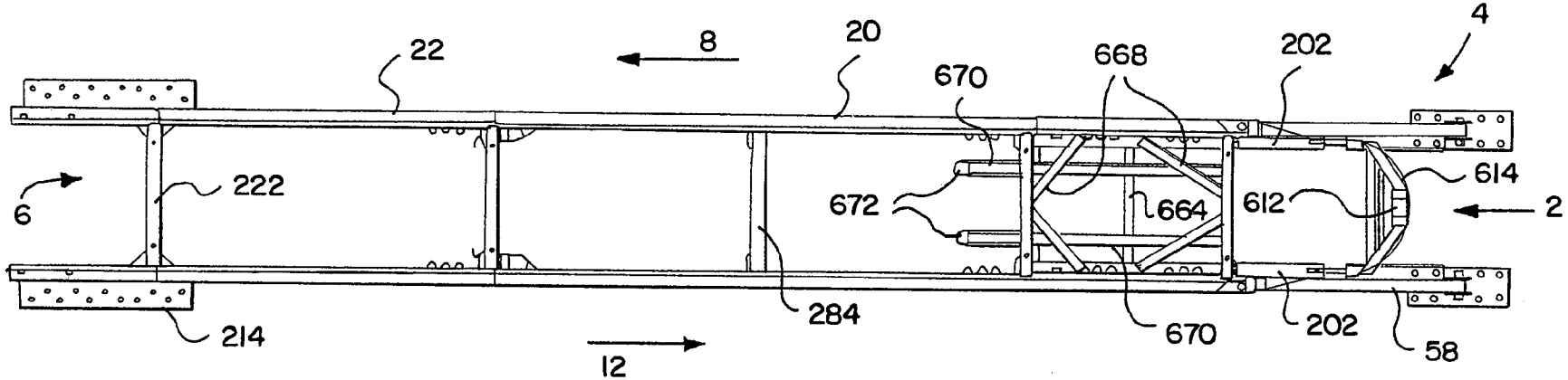
FIG. 33 is a top view of the crash cushion shown in FIG. 32.

Turning now to the drawings, FIGS. 1, 14 and 33 show views of a crash cushion 10 incorporating preferred embodiments of this invention. Preferably, the overall length of the crash cushion 10 between the front and rear ends 4, 6 thereof is less than twenty-five (25) feet. The crash cushion 10 is typically positioned alongside a roadway (not shown) having traffic moving in one or both directions 8, 12 parallel to the longitudinal direction 2. In FIG. 1, the crash barrier 10 is shown as mounted to the end of a roadside hazard 14, which can include without limitation, bridge abutments, concrete barriers, conventional guard rails, etc. As shown in FIGS. 1, 14 and 32-34, the crash cushion includes a frame 16 that is axially collapsible and includes a first section or bay 18, a second section or bay 20 and a third section or bay 22. It should be understood that the frame could be configured with more or less than three bays to accommodate more or less energy absorption.

Figure 28:
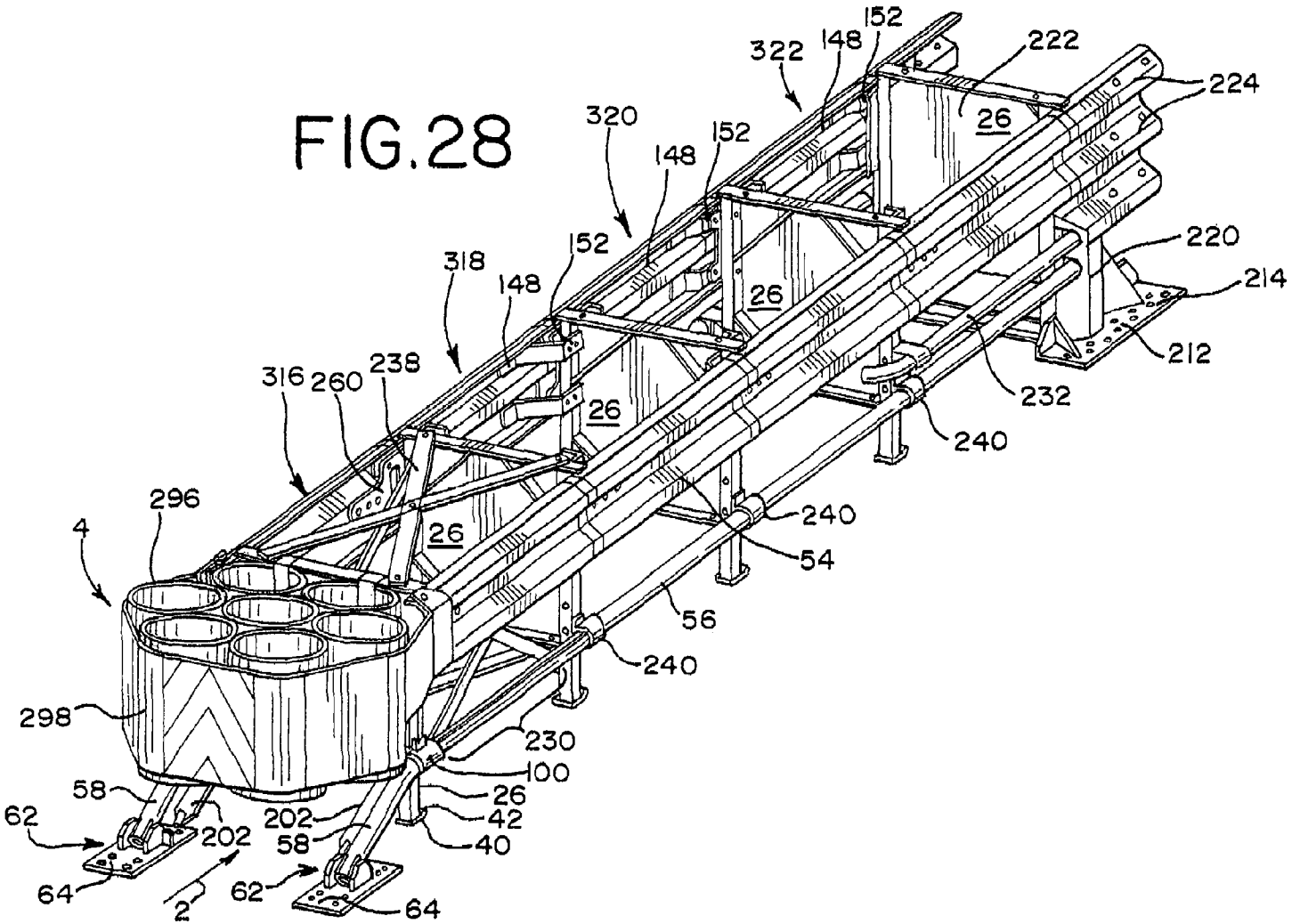
FIG. 28 is a perspective view of another a four-bay embodiment of a vehicle crash barrier.

For example, in one embodiment shown in FIG. 28, the crash cushion is configured with four bays 316, 318, 320, 322, preferably but not necessarily equal length. In any of the embodiments, the first bay can be configured to be rigid, i.e., not collapsible. For example, as shown in FIGS. 28, 14 and 32-34, the first bay 316, 18 is configured as a rigid bay, which acts as a sled. In embodiment, the four bays preferably are each approximately four feet in length, such that the overall system has a length of approximately sixteen (16) feet. In addition, the nose section 304 is preferably about three feet in length. Preferably, the crash cushion is positioned on a ground support surface that is substantially horizontal, and preferably less than about 8 degrees from horizontal in a side-to-side direction.

Referring to FIG. 1, the third section or bay 22 is secured to the roadside hazard 14 with a transition section 24 described below with reference to FIG. 11. In one exemplary embodiment, the rear end 6 is butted against a hazard 14 having a twenty-four (24) inch width, although it can be configured and used with hazards having greater or lesser widths.

Figure 39:
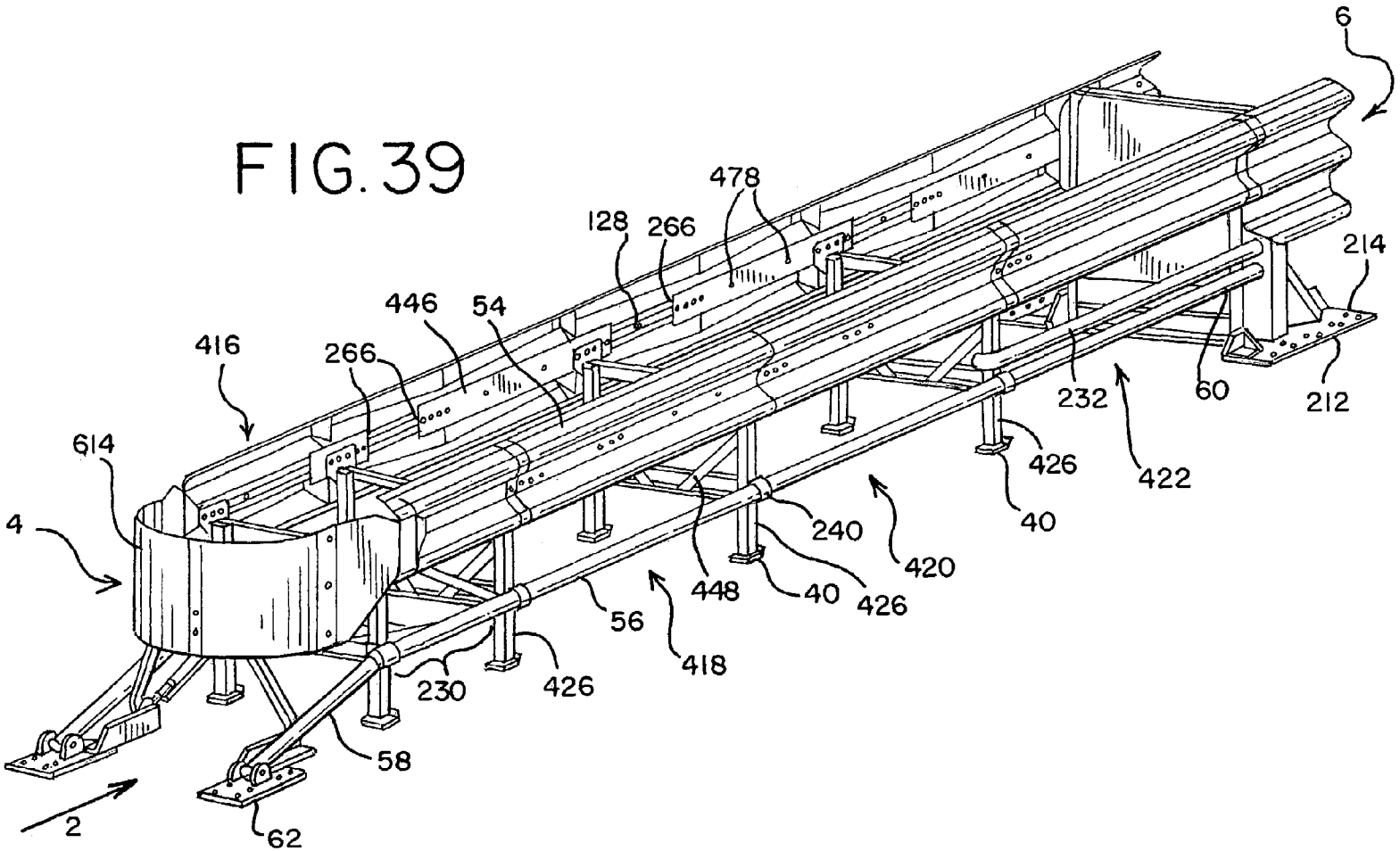
FIG. 39 is a perspective view of an alternative embodiment of a crash cushion.

Referring to the embodiment of FIG. 39, the crash cushion includes a rigid bay 416, preferably having a length of about three feet, and three modular, collapsible bays 418, 420, 422, each of which preferably has a length of about six feet.

Referring to FIGS. 1, 2, 14, 15, 17, 28, 32-34, 39 and 43 each of the bays 18, 20, 22, 316, 318, 320, 322, 418, 420, 422 is defined in part by a pair of support members 26, 426 or frames, otherwise referred to as diaphragms, spaced apart in the longitudinal direction 2. Each support member includes a top and bottom frame member 28, 30, 428, 430, configured in one embodiment as tubular members and in another embodiment as an L-shaped angle member, connected to a pair of opposite side frame members 32, 34, 432, 434 also configured as tubular members. The frame members are preferably made of galvanized steel and are welded together. Bottom portions 36, 38 of the side frame members 32, 34 extend below the bottom frame member. A foot member 40, having a curved leading edge portion 42 pointing rearwardly, are secured to the bottoms of the side frame members and define bottom support surfaces that slide along the ground. In one embodiment, the support member has a height of about thirty-two (32) inches, although greater and lesser heights would also work. For example, as shown in the embodiment of FIGS. 39 and 44, the support members 426 do not extend to the top of the crash cushion, but rather are aligned with an interior ridge 128 of the adjacent side panels 54, described in more detail below.

Figure 17:
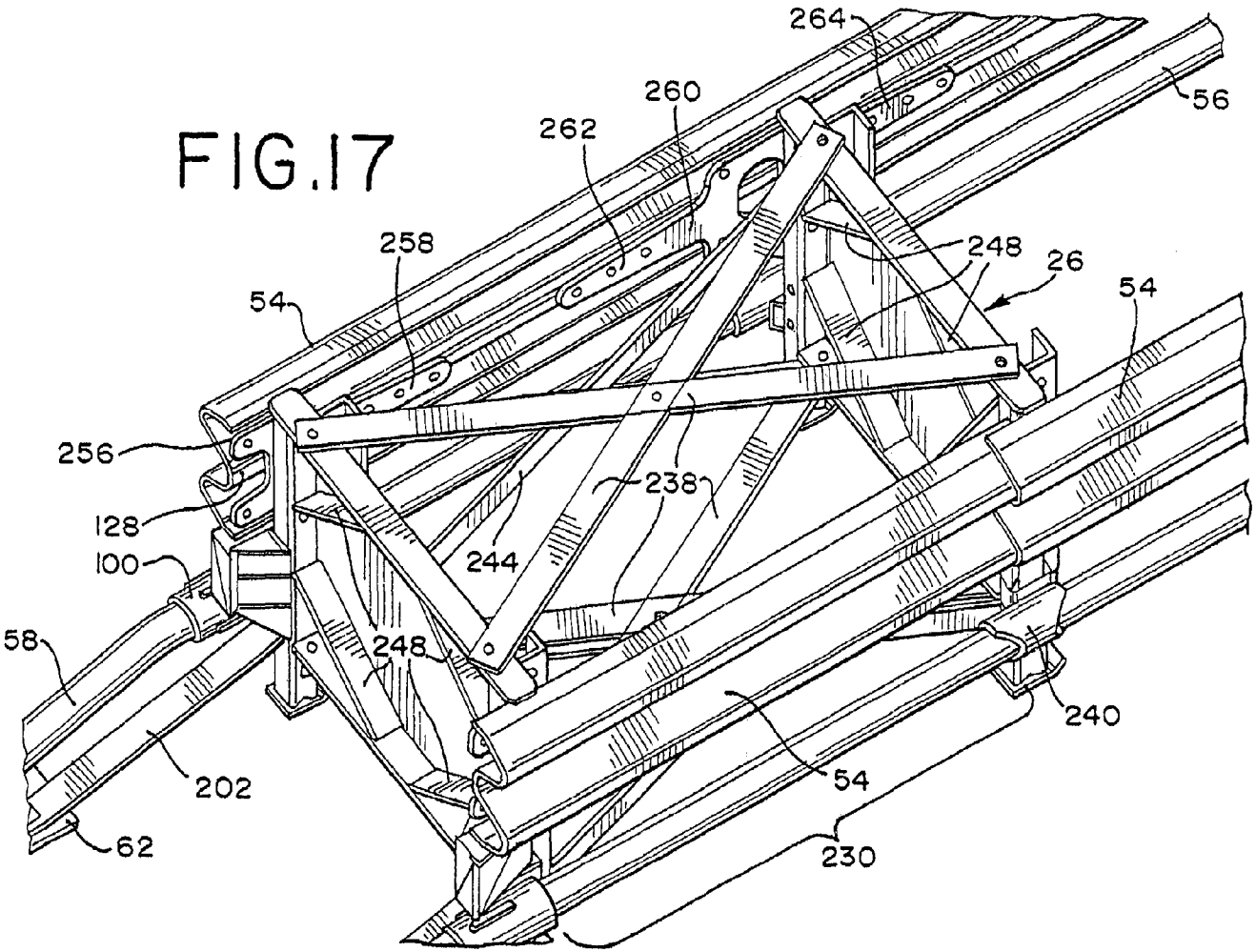
FIG. 17 is a top perspective view of the front bay of the crash barrier shown in FIG. 14.
Figure 34:
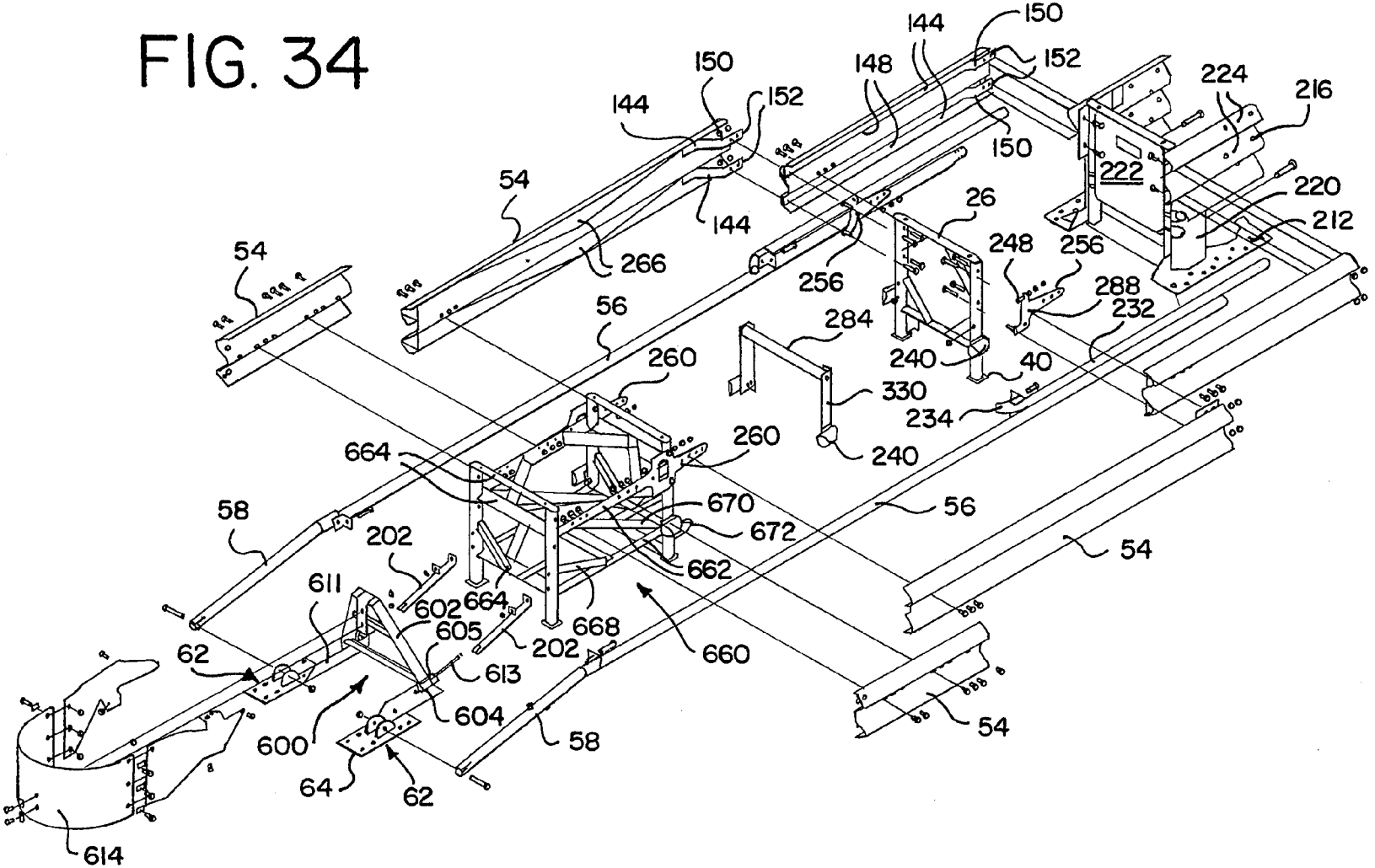
FIG. 34 is an exploded view of the crash cushion shown in FIG. 32.
Figure 35:
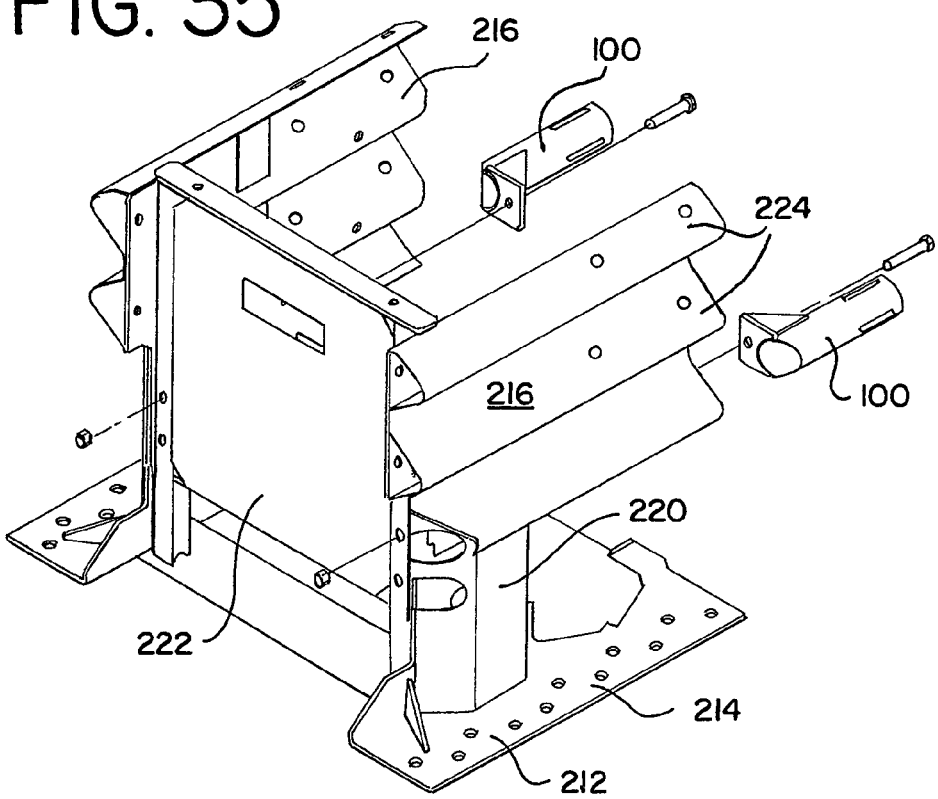
FIG. 35 is a partial exploded view of the backup structure shown in FIG. 32.
Figure 43:
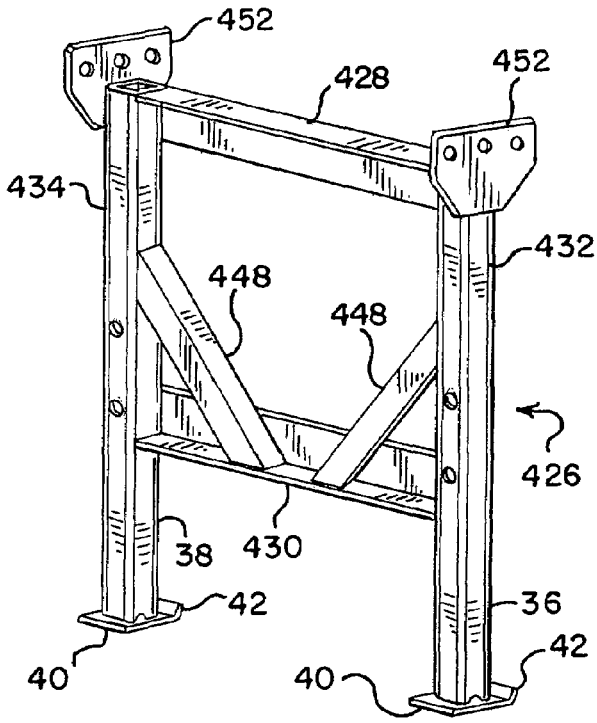
FIG. 43 is a perspective view of a support member incorporated into the embodiment of the crash cushion shown in FIG. 39.

As shown in FIGS. 1, 2, 14, 15, 17, 28 and 32-34, a shear panel 46 covers the opening formed by the frame members and is secured to the frame members to provide torsional rigidity to the support member 26. Various holes can be strategically positioned in the shear panel to reduce the overall weight of the support member. A pair of diagonal straps 48 are further secured between the middle of one of the side frames 32 and opposite adjacent junctions of the side frame 34 and the top and bottom frames 8, members 28, 30 to provide additional strength and rigidity. Alternatively, as shown in FIGS. 14, 17 and 34, four (4) diagonal brace members 248 extend between mid portions of each of the side, top and bottom frames. As shown in the embodiment of FIGS. 39 and 43, the support members 426 remains open and does not include a shear panel, which reduces the weight of the member, along with the reduced height thereof. A pair of diagonal brace members 448 extend between midpoints of the side frame members 432, 434 and the bottom frame member 430.

Referring to FIGS. 1, 2, 14, 15, 17, 28 and 32-34, a pair of upside down L-shaped brackets 50 are mounted to the opposite sides of the support member 26 and provide a locator for side panels 54 that are secured to the support member. A pair of vertically spaced and laterally extending holes 52 are made through the side frames 32, 34 above the brackets 50 for securing the frame 26 to the side panels 54. The rearward most support member is not intended to move substantially during an impact event, and the feet 40 thereof can be oriented in the opposite direction as shown in FIG. 1. Preferably, the various components disclosed herein, including the support members and side panels are made of galvanized steel.

Figure 44:
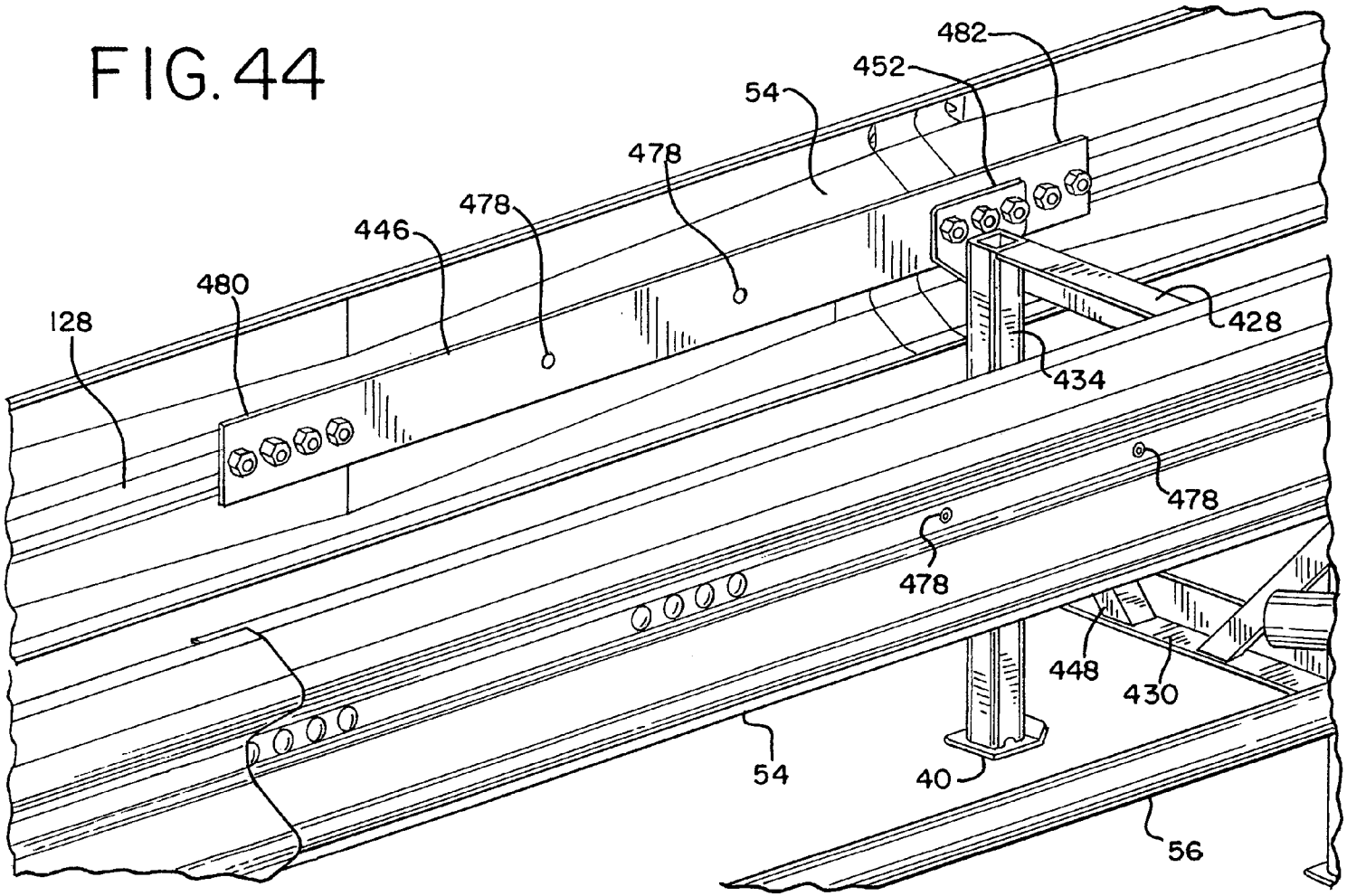
FIG. 44 is a partial perspective view of a portion of embodiment of the crash cushion shown in FIG. 39.

Alternatively, as shown in FIGS. 39, 43 and 44, a pair of mounting plates 452 is secured along the upper portion of the outer surface of frame members 432 and 434. The mounting plates are secured to the side panels 54.

Figure 37:
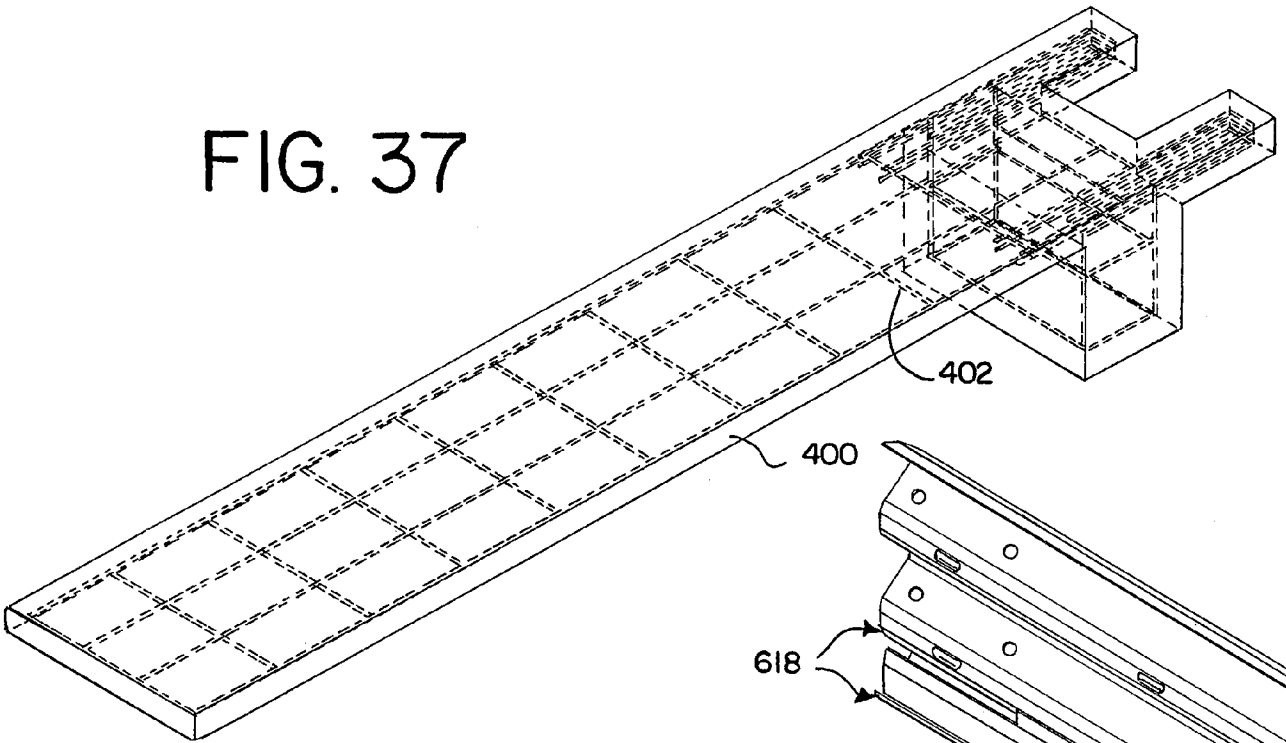
FIG. 37 is a perspective view of one embodiment of a concrete pad for supporting a crash cushion.

Referring to FIGS. 1, 3, 4, 14-17, 28 and 43 a pair of attenuator members 56 extend in the longitudinal direction between the front and rear 4, 6 of the crash cushion 10. Each attenuator member 56 is preferably made from a tube, and preferably has a circular cross-section, although it should be understood that a non-tubular, solid (deformable) or filled structure, or other non-circular shapes (tubular and otherwise) would also work. Each attenuator member 56 has a first end 58 secured to a first anchor 62 at the front end 4 of the crash cushion. The first anchor includes a plate 64 secured to the ground with various fasteners and one or more upstanding flanges 66. In the embodiment of FIG. 1, the flange 66 is braced with various corner brackets 68 and includes a pair of rearwardly facing mounting flanges 70. A pair of connector members 72 each includes a pair of straps 74 having first ends secured to the mounting flanges 70 with a pin 76 or fastener permitting rotation of the connectors 72 relative to the anchor 62. Opposite second ends of the connector straps 74 are pivotally secured to the ends 58 of the attenuator members with a pin 78 or other fastener. The front anchor 62 can be secured, for example, to six (6) inch reinforced concrete or six (6) inch thick asphalt covering a six (6) inch substrate, for example a compacted aggregate base. In one embodiment, shown in FIG. 37, the crash cushion is secured to a concrete pad 400, which is reinforced with rebar 402.

As shown in the embodiment of FIGS. 14, 15, 16, 19, 28, 34 and 39, the tubes have a downturned or bent end 58 that are directly connected to the anchor plate 62. The ends of the tubes can be angled inwardly toward the anchor, or they can be maintained within the same vertical plane as the remainder of the tube.

Referring to FIGS. 15, 16, 34, 39 and 40, a tension strap 202 has a first end secured to the front support member 26, 426 with the same fastener 204 that secures a deforming member thereto, as described below. The tension strap is preferably made of ¼ inch by 2 inch steel. A second end of the strap is secured to a threaded rod 206, for example a ½ inch diameter rod. The threaded rod is threadably secured to the front anchor plate 64, which includes an upstanding flange 208. One or more tightening nuts 210 can be tightened to put the strap 202 and attached crash cushion 10 in tension. This in turn increases the overall lateral stiffness of the crash cushion, offering lateral stiffness higher on the crash cushion in combination with the lateral stiffness provided by the lower attenuator members. In addition, tensioning the system provides for the nose portion 4 of the crash cushion to collapse first before any downstream movement of the system. By preventing downstream movement prior to complete collapse of the nose portion, the momentum transfer "spike" from the weight of the downstream bays, and in particular the bay one sled, is separated from the nose collapse. As such, the duration of the delta V is extended so as to thereby reduce the delta V.

Figure 36:
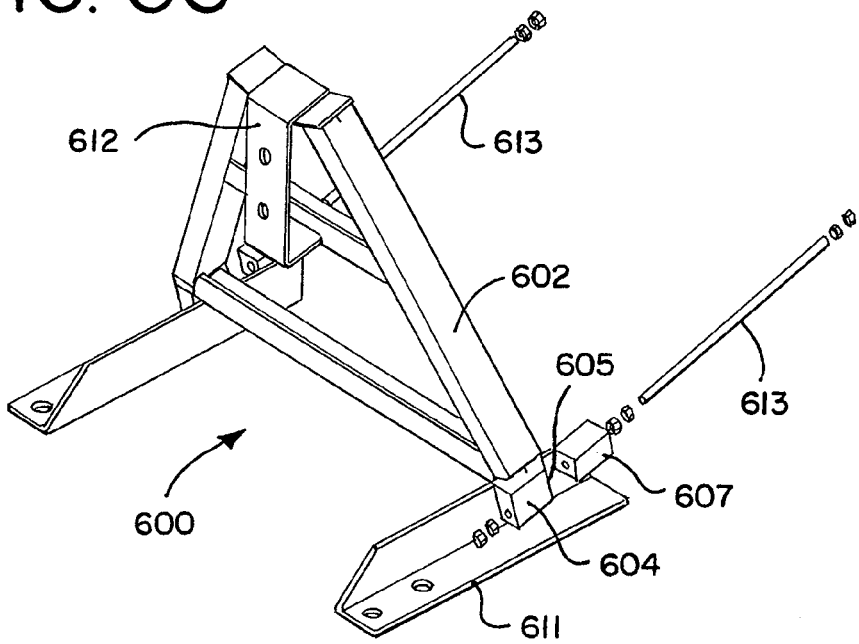
FIG. 36 is an exploded view of the trigger assembly shown in FIG. 32.
Figures 40, 41:
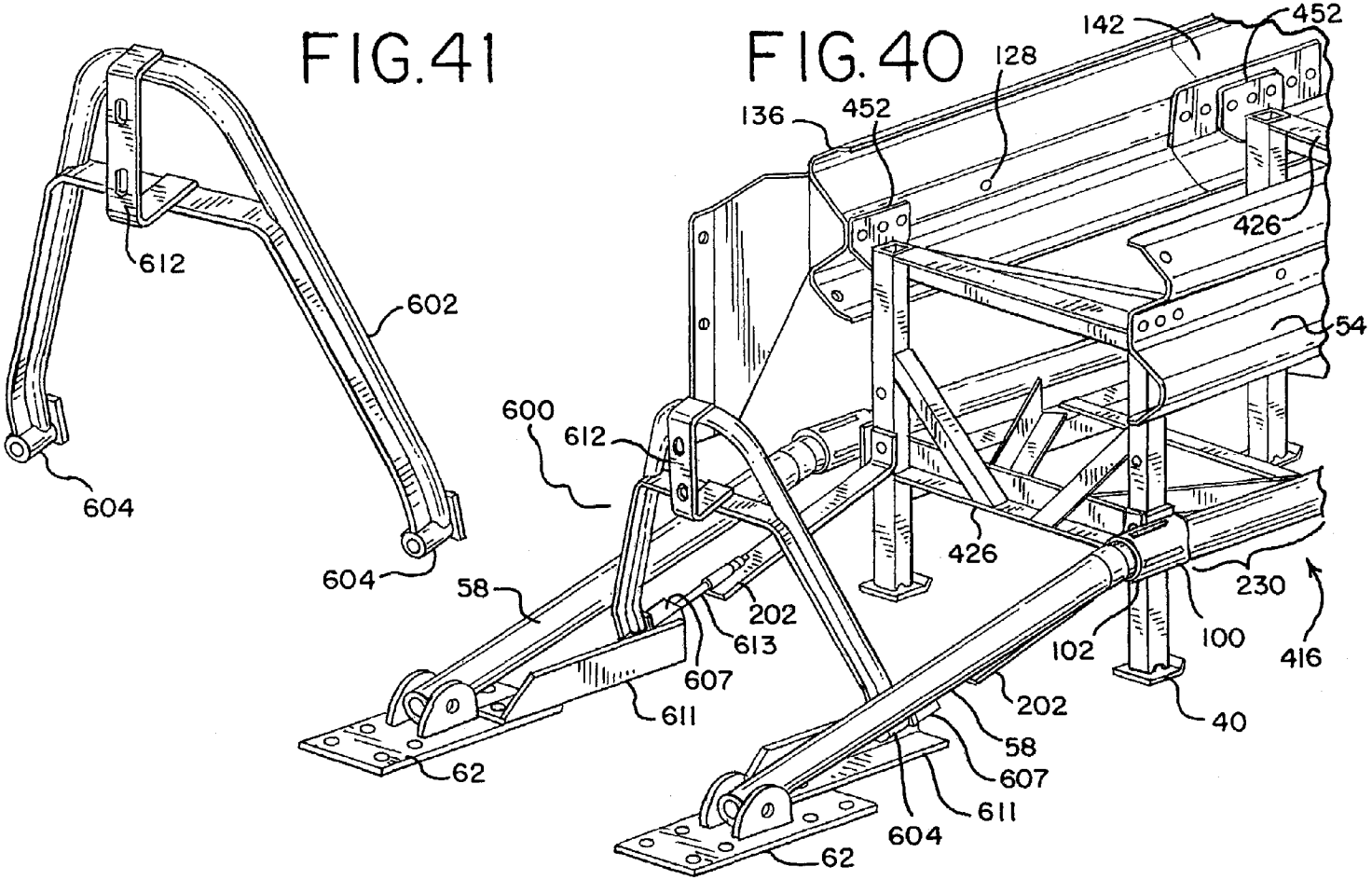
FIG. 40 is a partial perspective view of the trigger assembly for the crash cushion shown in FIG. 39.
FIG. 41 is a perspective view of a lever arm used in the trigger assembly of FIG. 40.
Figure 42:
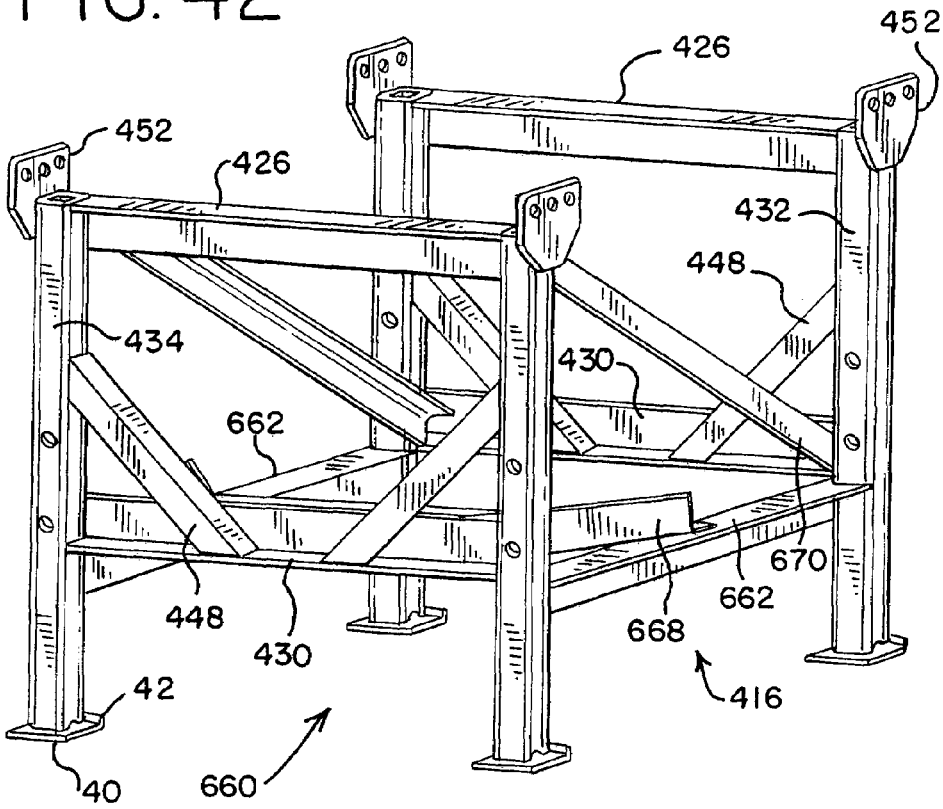
FIG. 42 is a perspective view of a rigid sled bay incorporated into the embodiment of the crash cushion shown in FIG. 39.

As shown in FIGS. 32, 34, 36 and 39-41, a trigger assembly 600 is secured to the second end of the strap 202. One suitable trigger assembly is disclosed in U.S. Pat. No. 5,022,782, assigned to Energy Absorption Systems, Inc., the same assignee as this for the present application, and which patent is hereby incorporated herein in its entirety. For the crash barrier 10 to operate as intended, it is important that the frame be released from the front anchor assembly 62 during an axial impact. This function is performed by the breakaway trigger assembly 600, as best shown in FIGS. 32, 34 and 36. This breakaway assembly 600 includes a lever arm 602 that terminates at its lower end in a pair of tubes 604. Each of the tubes 604 defines a fulcrum 605 adjacent its upper edge, where it bears against a reaction surface formed by a respective reaction tube 607. As shown in FIGS. 36 and 41, the lever arm 602 is generally V-shaped. The upper end of the lever arm 602 is rigidly secured to a plate 612, which is in turn secured by fasteners to a nose plate 614. The nose plate 614 is generally C-shaped, and is secured by fasteners at its rearward edges to the side panel 54 and side frame members.

The frame 16, 416 described above is not secured to the ground in any way, other than by way of the attenuator members and anchor structures. The reaction tubes 607 are secured, as for example by welding, to a L-shaped base 611, which is secured to the front anchor 62. As shown in FIGS. 36 and 40, the tubes 604, 607 are oriented axially and tilted slightly such that the front ends are lower than the rearward ends.

As shown in FIGS. 32, 36 and 40, the reaction tubes 607 are used to secure the front section 16, 416 to the front anchor assembly 62 by means of bolts 613. These bolts 613 are secured at their rearward ends to the strap 202 rigidly mounted on the front support member of the first bay of the support frame. The bolts 613 pass through the reaction tubes 607 and are held in place by nuts. The front anchor assembly 62 serves to anchor the front end of the frame 16 when the frame 16 is struck laterally by an impacting vehicle moving obliquely with respect to the axial direction.

As shown in FIGS. 32, 36 and 39-40, the lever arm 602 is oriented obliquely with respect to the vertical direction, with its upper end positioned forwardly of its lower end. During an axial impact, the impacting vehicle contacts the nose plate 614 and pushes the plate 612 rearwardly. This pivots the lever arm 602 about the fulcrum, providing a large elongating force which parts the bolts 613. Once the bolts are parted, the support frame 16 is released from the front anchor assembly 62, and the frame is free to collapse axially as it decelerates the impacting vehicle. The lever 602 arm remains attached to the nose plate 614 and is sandwiched between the nose plate and first bay during the collapse sequence.

It is important to recognize that the breakaway assembly responds preferentially to an axial impacting force to part the bolts 613. If the nose plate 614 is struck at a large oblique angle, or if the crash cushion 10 is struck obliquely along its length, the lever arm 602 does not pivot around the fulcrum, and the breakaway assembly does not function as described above. This direction specific characteristic of the breakaway assembly provides important advantages.

Referring to FIG. 1, a second, rear anchor 80 is secured to the roadside hazard 14 or ground at the rear 6 of the crash cushion. The anchor 80 includes a plate 82 mounted to the hazard or ground with a plurality of fasteners. Preferably, the total number of anchor bolts (front and rear) is less than thirty-six (36) and preferably less than thirty (30). The anchor 80 further includes a support platform 84 with an opening 86 formed therethrough. A connector 88 includes a clevis structure 90 pivotally secured to the second, rear end 60 of the attenuator member with a pin 92 or other fastener. The connector 88 further includes a threaded fastener 94 extending between the support platform 84 and clevis 90. The fastener 94 can be rotated to tighten the connector and to thereby remove construction slack and put the attenuator member 56 in tension. For example, in one embodiment, 120 ft-lb torque is applied to a ⅞ inch fastener to provide approximately 10,000 lbf of tension. In other embodiments, the tension is limited to a force adequate to remove slack between the various barrier components. In various embodiments, the tension is preferably between about 1,000 lbf and about 20,000 lbf and preferably between about 5,000 lbf and about 15,000 lbf. Of course, it should be understood that the tension could be greater than 20,000 lbf.

Figure 31:
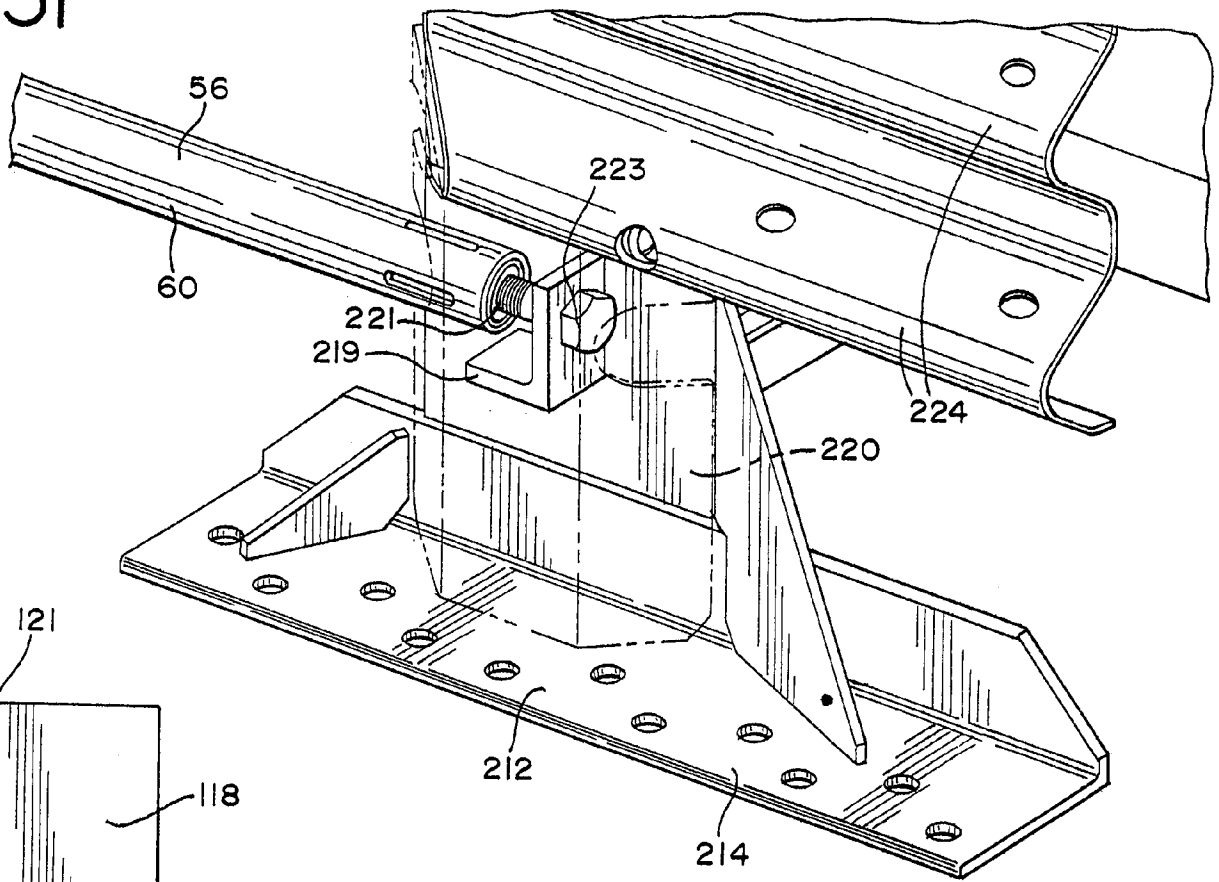
FIG. 31 is a partial perspective view of a backup structure having an attenuator tube secured thereto with a tensioning mechanism.

As shown in FIGS. 14, 24, 25, 28 and 39, a stand-alone backup structure 212 is secured to the ground and is not dependent on the roadside hazard for absorbing any of axial or lateral load upon impact by a vehicle. In this embodiment, the second end 60 of the attenuator member 56 is secured to the backup structure and can be tensioned thereto with a tensioning mechanism, shown in FIG. 31. In particular, a bracket 219 is secured to an upright 220 and a tensioning bolt 223 is threadably engaged with a plug portion 221 inserted in the end of the attenuator tube 56. The bolt 223 can be rotated to put the attenuator tube 56 in tension, as described above.

A base 214 of the backup structure is bolted or otherwise secured to the ground. A frame structure 218 includes a pair of uprights 220 and a panel 224, configured as support member 26, which extend upwardly from the base 214. The backup structure provides a dual anchor, allowing the overall system to be put in tension using the tension strap 202 as described above, as well as allowing the attenuator member to be put in tension. In addition, the backup structure absorbs tensile loads applied by the attenuator and side panels, for example in a lateral impact when redirecting a vehicle. Conversely, the backup structure is sufficiently rigid to absorb the compressive axial loads applied by the crash cushion during an impact. The backup structure includes thrie-beam side panels 216 that extend rearwardly from the frame structure 218, with two upper exterior ridges 224 of the beam mating with the W-beam side panels 54 of the third bay 22. The thrie-beam panels are mounted at the industry standard height of 21⅝ inches to the center line thereof. In this way, the crash cushion can be secured to industry accepted/standard transition structures and roadside hazards/barriers.

The attenuator tube is preferably made of metal, such as two inch Schedule 40 pipe, or alternatively 2⅜ inch outer diameter (OD) 9 gauge hot dipped galvanized tubing. In other embodiments, the attenuator tube is made of 10 gauge tubing. Of course, it should be understood that the tube can be made of other materials, including without limitation aluminum, plastic, etc. Various portions of the tube can be filled with a material, such as rubber, water, plastic, sand, polyurethane foam, etc., to provide different deformation properties. The outer surface of the tube can also be treated, for example with different metals, plastics and/or lubricants, to provide different dissipation properties along the length thereof.

Figures 2, 3:
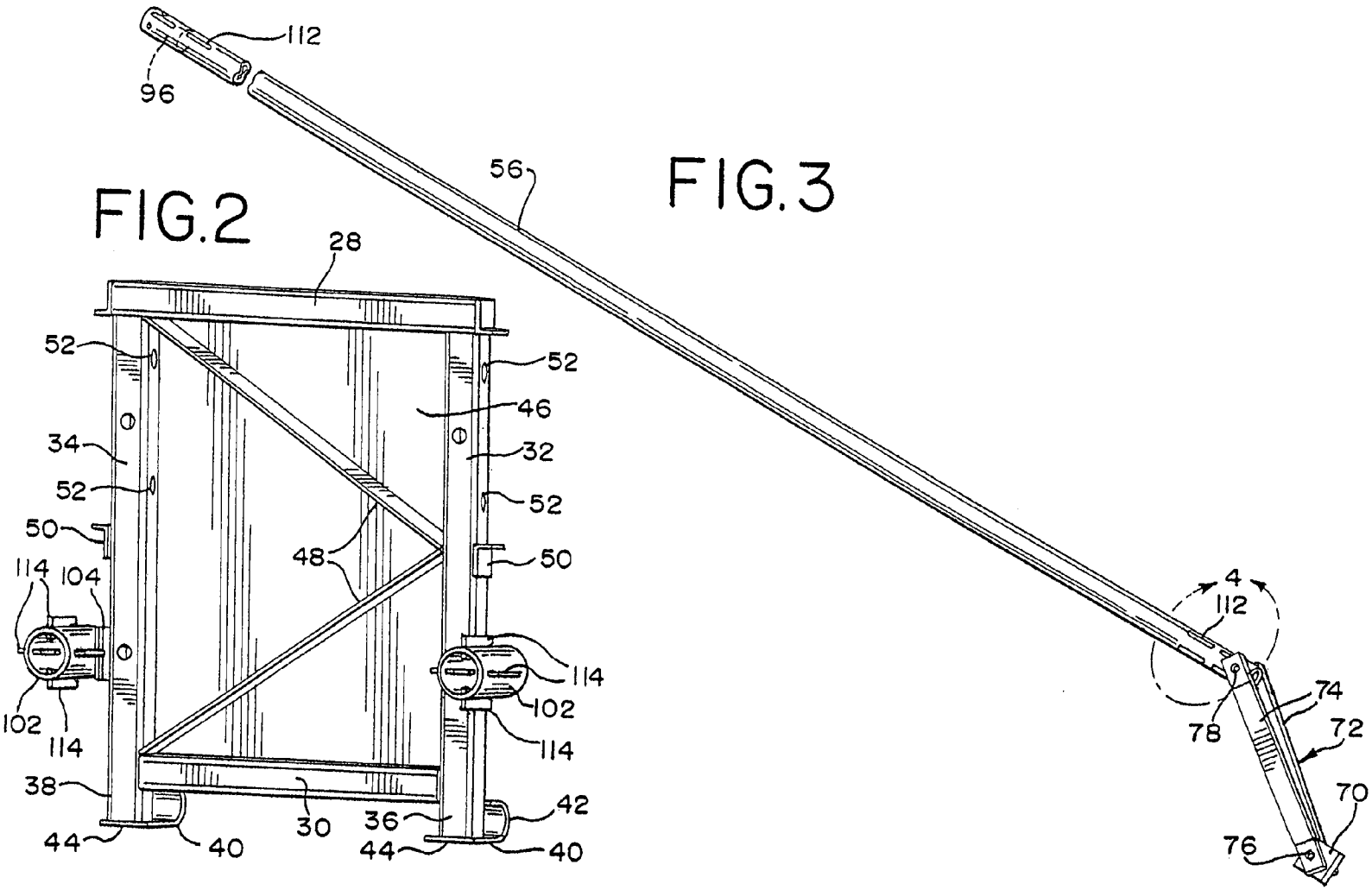
FIG. 2 is a perspective view of a support member having a deforming member connected thereto.
FIG. 3 is a perspective view of an attenuator assembly.
Figure 4:
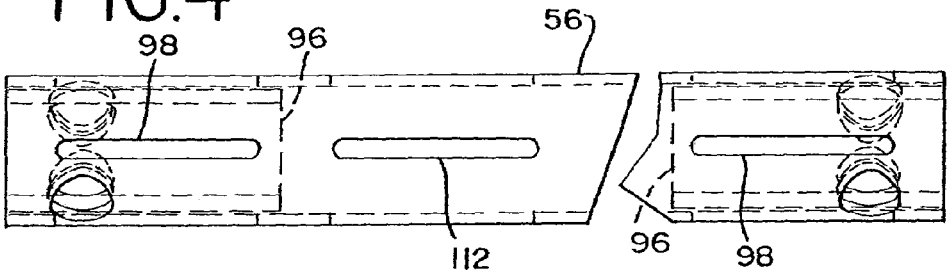
FIG. 4 is partial perspective view of a portion of an attenuator member taken along line 4 of FIG. 3.
Figure 5:
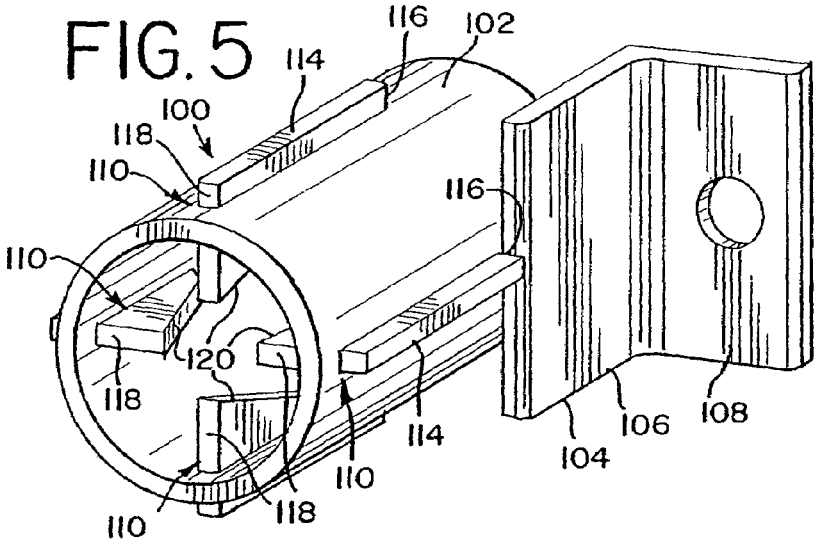
FIG. 5 is a perspective view of a deforming member.

Referring to FIGS. 3 and 4, a second tube 96 is welded inside the first attenuator tube at each end thereof. Slots 98 are provided in the outer tube 56 to allow the inner tube 96 to be welded thereto through the slots 98. The second tube 96 provides increased thickness and bearing strength for the pivot pins 78 so as to reduce the risk of tear out at loads approaching the ultimate strength of the first tube.

Referring to FIGS. 1, 2, 5 and 12, a deforming member 100 is configured with a housing 102 that is shaped to be disposed around the attenuator member tube 56. In one embodiment, the housing is configured as a tube. The housing 102 is secured to an L-shaped mounting bracket 104, for example by welding. One flange 108 of the bracket is secured to the support member 26 on one side thereof, for example by welding or by passing a bolt through a longitudinally extending opening, while another flange 106 is secured to the housing 102. The housing 102 has a plurality (meaning two or more) of circumferentially spaced and longitudinally oriented slots 110 (shown as four) formed therethrough. The slots 110 are positioned to be aligned with a plurality of longitudinally oriented slots 112 circumferentially spaced around the tube member (FIGS. 3 and 4) when the housing is disposed over the attenuator member tube 56. A plurality of plate members 114 are inserted through the aligned openings 110, 112 and are secured to the housing tube 102 by welding.

It should be understood that more or less plate members can be used, and that the depth of the plate members can be altered to change the energy dissipation capability of the deforming member. For example, in various embodiments, the minimum distance or gap between opposing plate member ranges from about 1 inch to about 1 and ¾ inches, and includes for example and without limitation gaps of 1 inch, ¼ inches, 1⅜ inches, 1½ inches, 1⅝ inches and 1¾ inches. Of course, it should be understood that other spacings or gaps greater than 1¾ inches and less than 1 inch would also work. It should also be understood that the shape of the interior of the housing 102 can be varied, but preferably corresponds to and mates with the exterior shape of the attenuator member tube 56 such that the housing slides along the attenuator member.

Figure 30:
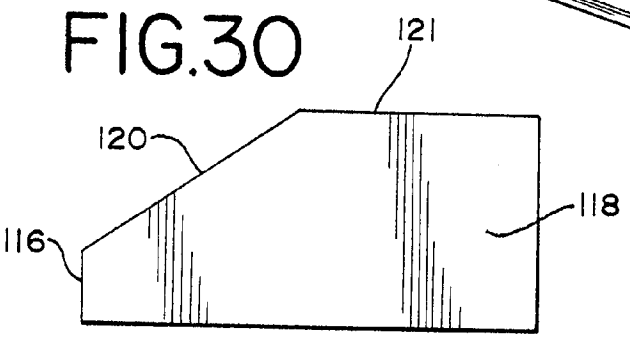
FIG. 30 is a side view of one embodiment of a deforming plate.

Each plate member 114 has a leading portion 116 and a trailing portion 118, with a tapered contact surface 120 extending between the leading and trailing portions 116, 118. The trailing portion of the contact surface 120 impinges on the attenuator member 56, or extends a greater radial distance into the interior of the attenuator member, than does the leading portion of the contact surface. The trailing portion of the contact surface may also be formed with a horizontally extending linear edge portion 121 as shown in FIG. 30, rather than terminating at a point formed with an end surface, so as to minimize wear to the contact surface.

In one embodiment, shown in FIGS. 14, 17, 19, 28 and 39, an initial portion 230, or predetermined length, of the attenuator member 56, or tube portion thereof, is crimped or preformed to form a cross-sectional profile that mates with a deformation profile defined by the plate members 114 of the deforming member 100. The two profiles are shown in FIG.

12. In this way, the engagement of the deforming members with the attenuator member 56, which has a downstream portion defining a cross-sectional profile that differs from the first cross-sectional profile and the attendant energy absorption, can be delayed, for example until after the delta V time. It should be understood that the deforming member and attenuator member can be configured so that the deforming member deforms the attenuator member along both portions defining the first and second cross-sectional profiles, but to different degrees, or such that it deforms only one such portion. In another embodiment, the attenuator tube is provided with slots (not shown) formed along a predetermined length of the tube that mate with the plate members so as to again delay the onset of the energy dissipation by the deforming member engaging the attenuator member.

The housing member 102 and bracket 104 are configured and attached to the support member such that at least a portion, and preferably the entirety, of the contact surface 120 is positioned forwardly of or on a front side of, the support member 26, 426 to which it is secured. In this way, when the support member 26 is moved during an axial impact, for example by loads being applied to the side panels 54 or by direct impact with the support member 26 by way of the nose 4, the support member 26, 426 pulls the deforming member 100 along the attenuator member 56, rather than pushes it therealong. Of course, it should be understood that in other embodiments, the deforming member is pushed along the attenuator member. When pulled, the deforming member 100 is less likely to bind on the attenuator member 56 and a more reliable attenuation curve is obtained. It should be understood that the reference to the deforming member being engaged with at least a portion of the attenuator member on the front side of the support member refers to at least a portion of the deforming member engaging at least a portion of the attenuator member forwardly of the plane or point of contact wherein the impact load is applied to the support member, for example at the openings 52 where the side panels 54 are secured to the support member 26, or where the nose portion contacts the support member.

It should be understood that the crash cushion 10 can be configured with only one attenuator, or with more than the two attenuator members shown. For example, as shown in FIGS. 14, 23, 27 and 39, an additional pair of auxiliary attenuator members 232 each have a first end 234 fixedly secured to an intermediate support member and an opposite end 236 disposed in a deforming member 100 secured to the upright 220 of the backup structure. The first end 234 of the attenuator is curved or bent inwardly so as to not become a snagging hazard. A rear portion of the attenuator 232 can be crimped or otherwise have its cross-section altered to form a cross-sectional profile that mates with a deformation profile of deforming member 100 secured to the back-up structure, such that the attenuator 232 dissipates a lesser amount of energy during an initial translation. The auxiliary attenuator member 232 is disposed above the primary attenuator member 56, although it could be disposed therebelow, and acts as an additional rub rail that redirects a side impacting vehicle. In addition, the additional attenuator members 232 increase the overall lateral stiffness of the corresponding bay 22, e.g. the third bay, to which they are coupled. In this embodiment, the attenuator 232 is pushed by and moves with the support member 26, 426 as the attenuator 232 is deformed by the deforming member secured to the backup structure 212. It should be understood that any of the support structures can be coupled to an auxiliary attenuator member, and further that the additional attenuator members can extend to the next subsequent support member, or beyond to another support member. By increasing the energy absorption of the system using auxiliary attenuator members, a 19 foot long crash system can safely stop a vehicle travelling at 70 mph.

Figure 6:
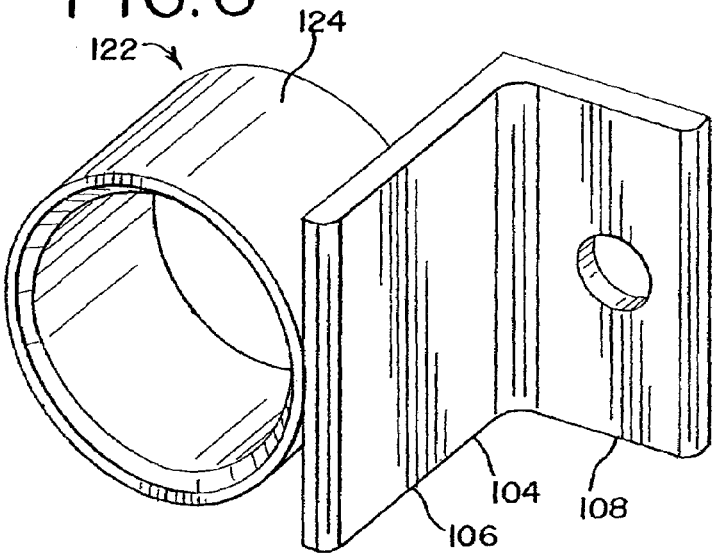
FIG. 6 is a perspective view of a guide member.

In other various embodiments, deforming members 100 can be secured to more than one support member to act on the same attenuator member. In one embodiment, and referring to FIGS. 1 and 6, wherein a deforming member is not secured to a support member, a pair of guides 122 are secured to the opposite sides of the support member 26. The guides have a guide housing 124 similar to the deforming member housing and a similar mounting bracket 104. The guides 122 are disposed around the attenuator tube 56 and guide the support member 26 along the tube 56 during an axial collapse. At the same time, the guides 122 hold the attenuator member 56 at a location vertically spaced from the ground and the support surface 44. In one embodiment, the distance between the ground and the centerline of the attenuator tube is about 10 inches. The guides and deforming members, in combination with the attenuator member, help prevent the crash barrier from overturning in the event of a side impact, and further guide the collapsing crash cushion rearward upon frontal impacts.

Figure 20:
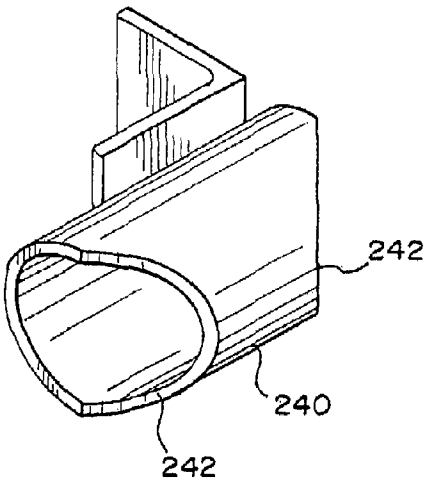
FIG. 20 is an alternative embodiment of a deforming member.

Referring to FIGS. 14, 17 and 20, an alternative embodiment of a guide member 240 has beveled or tapered portions 242 on each end thereof. Deforming members (see e.g., FIG. 40) can be formed with similar beveled entry and exit ports. The beveled guide members 240 and deforming members reduce the tendency of a vehicle, such as a wheel, to snag or catch on the member.

Referring to FIGS. 1, 7-10 and 13, each of the sections or bays 18, 20, 22 is further defined in part by a pair of side panels 54, otherwise referred to as fender panels. Each side panel 54 is preferably configured as a W-shaped beam having a pair of interior valleys 126 and an interior ridge 128, corresponding respectively to a pair of exterior ridges 132 and an exterior valley 130. The first bay is also configured with a diagonal brace member 134, or tension strap, extending between the support members 26 defining in part the first bay.

Figure 15:
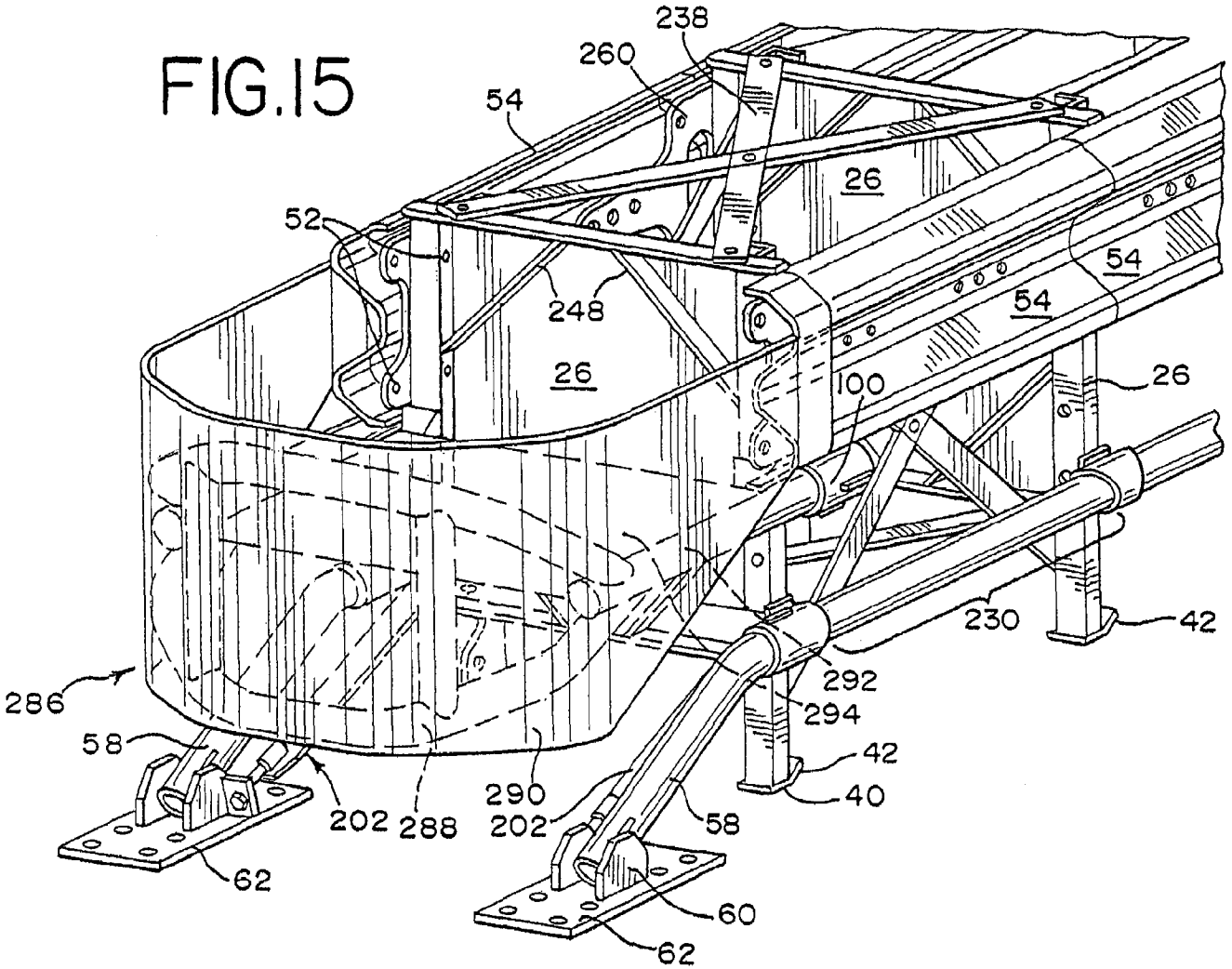
FIG. 15 is a perspective view of an alternative embodiment of a nose assembly for the crash barrier.
Figure 16:
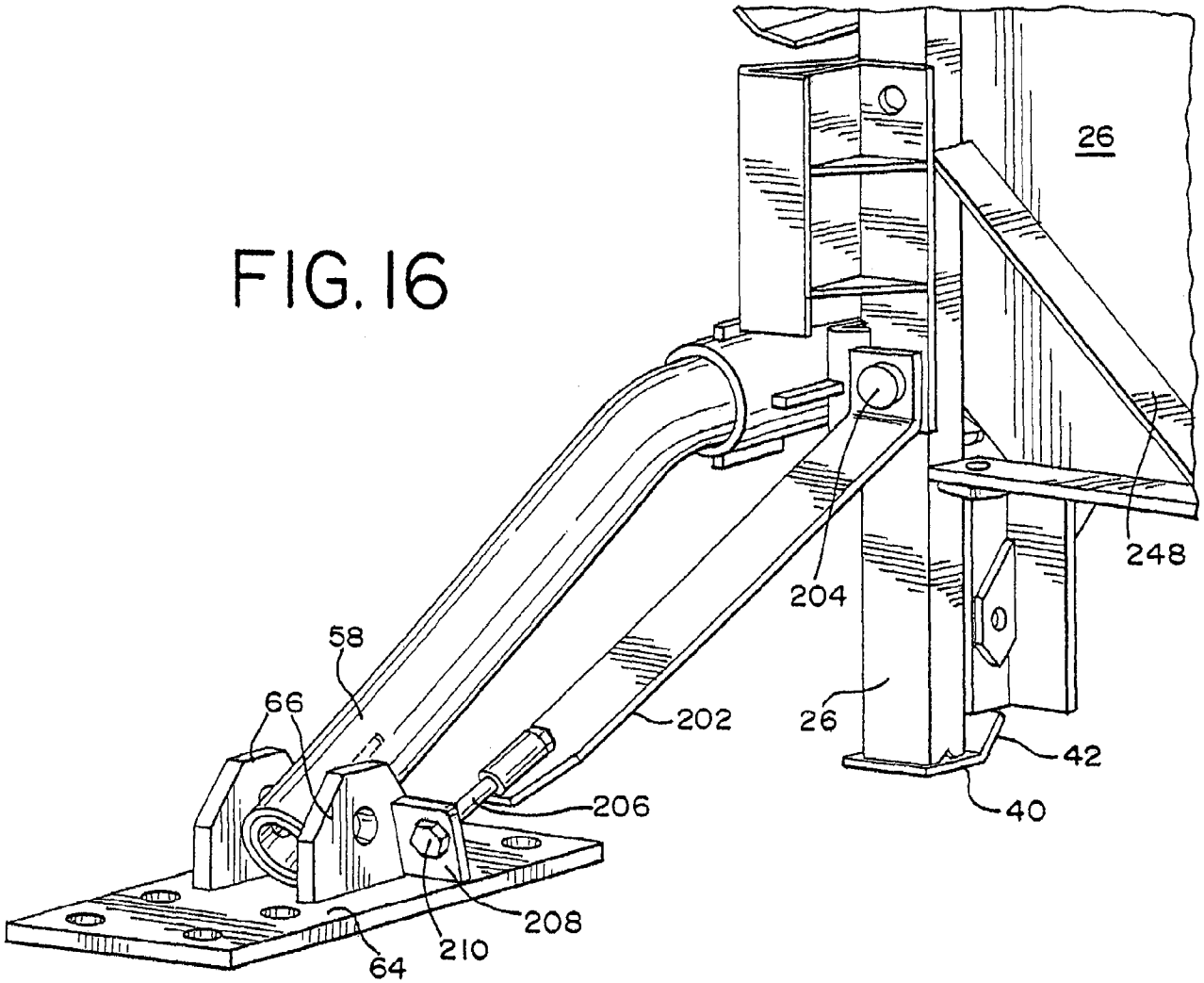
FIG. 16 is an enlarged perspective view of the anchor assembly for the front of the crash barrier shown in FIG. 14.

In the embodiment of FIGS. 14, 15 and 17, additional horizontal brace members (e.g., ¼ by 2 inch steel) extend between the support members defining the first 238 and third bays. The brace members cross each other and are secured at the crossover juncture. Likewise, two pairs of vertical brace members 244 cross and are secured one to the other in the first bay. The brace members are provided to increase the rigidity and prevent racking of the first bay. In other embodiments, the first bay is configured without any diagonal brace members. Alternatively, the other bays, including for example and without limitation the third bay as shown in FIG. 14, can be configured with one or more horizontal or vertically oriented diagonal braces to increase the stiffness thereof as desired.

Referring to FIGS. 32-34 and 39, the first bay is configured as a rigid bay with an internal support frame 660 having horizontal frame members 662 connecting the support members 26, 426 which include vertical and horizontal frame members 664, and diagonal brace members 668 secured to the horizontal members 664, 662. A pair of longitudinally extending diagonal brace members 670 run from and are secured to the top of the forwardmost support member to a lower portion of the next rear support member defining the first bay and terminate at a pair of feet 672. The feet are positioned laterally inward from the support member feet 40 such that the feet 672 and brace members 670 can slide under rearward support members in the second and third bays upon collapse of the crash cushion. The feet 672 provide additional support for the front bay and resist tipping.

Figure 7:
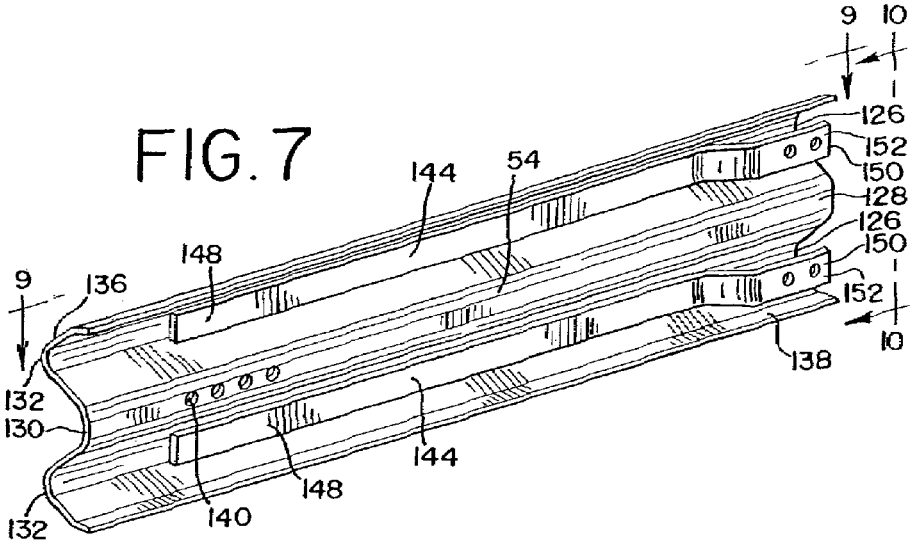
FIG. 7 is a perspective view of a side panel with a pair of first strap portions connected thereto in respective valleys.
Figure 8:
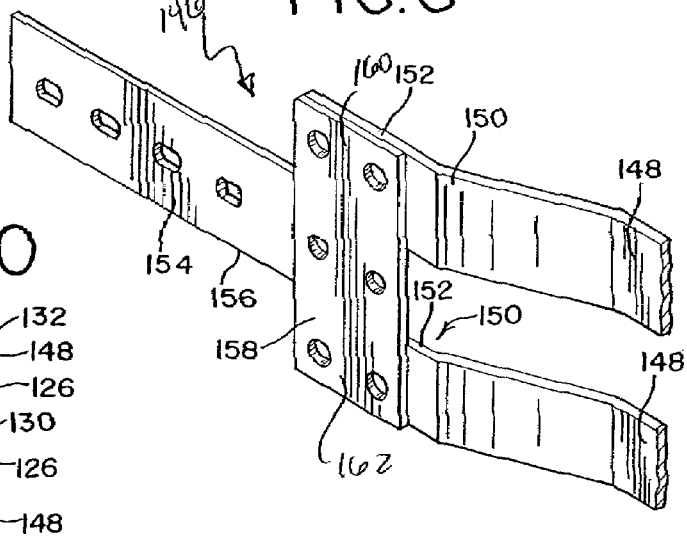
FIG. 8 is a partial perspective view of a connector including portions of a pair of first strap portions secured to a second strap portion.

Referring to FIGS. 1, 7 and 39, first ends 136 of the side panels of the first bay 18, 416 are secured to the opposite sides of the first support member 26, 426 with a plurality of fasteners, extending for example through openings 140 formed in the ridge 128, and in FIGS. 39 and 40 the mounting plate 452. The side panels 54 extend the length of the bay 18 and have opposite second ends 138 positioned adjacent the second support member 28 defining in part the first bay. First ends 142 of the side panels 54 of the second bay 20, 418 are disposed laterally inward from the second ends 138 of the side panels 54 of the first bay 18, 416 in an overlapping relationship.

A connector 146 (FIG. 8) connects the side panels 54 of the first and second bays 18, 20 to each other and to the support member 26 defining in part the first and second bays. The connector 146 includes a pair of first strap portions 144 having an elongated portion 148 disposed in the interior valleys 126 of the side panel. Rear portions 150 of the first strap portions are formed in a slight S-shape, with an end portion 152 being laterally offset from the elongated portion. In one embodiment, there are two 45° bends, with an approximate three (3) inch offset. The elongated portion 148 is welded to the side panel 54 along opposite sides of the elongated portion. In one embodiment, the elongated portion 148 is secured at a plurality of longitudinally spaced attachment locations. For example, the strap portion can be welded with welds staggered along the top and bottom thereof. In one embodiment, the strap portions are made of ⅜ inch×2½ inch flat bar. In various embodiments, the strap portions have lengths from about 12 inches to about 40 inches, up to 63 inches or other various lengths as desired.

As shown in FIGS. 39, 40 and 44, the connector is formed as a strap 446 having a rear end 482 that is bolted to the side panels 54 at ridge 128 between the side panels and the mounting plates 452 of the support members. The straps 446 can be made of laminated straps of material, as shown for example in U.S. Pat. No. 5,022,782, which is incorporated herein by reference. As shown in FIG. 44, the straps 446 run forwardly and have a forward end 480 connected to a midpoint of the side panel. A pair of small fasteners 478 secured intermediate points of the strap 446 to the side panel to ensure the strap buckles outwardly during collapse as the fasteners influence the column instability but do not absorb a large amount of energy as they are torn out of the strap or side panel during collapse. The bolts securing the forward and rear ends 480, 482 are not intended to be pulled through the side panel or strap, but rather remain and maintain the connection between the side panel and strap during the collapse sequence. The space between the forward and rear ends is sufficient such that the strap bends as the side panels of a forward bay move past the side panels in a next adjacent rear bay. In turn, since the bolts remain intact, the side panels are prevented from flaring outwardly during impact as the bays collapse. The thickness of the straps 446 can be increased to ensure proper staging of the crash cushion during impact.

Figure 18:
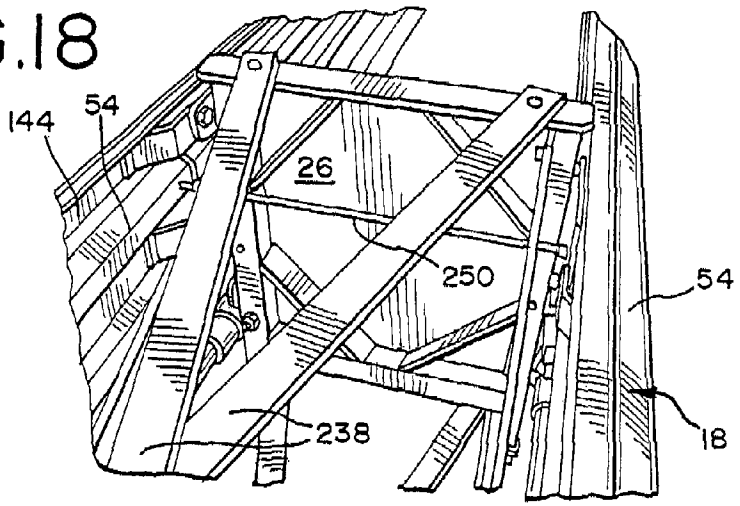
FIG. 18 is a partial top view of the front bay of a crash barrier having a trigger mechanism.
Figure 19:
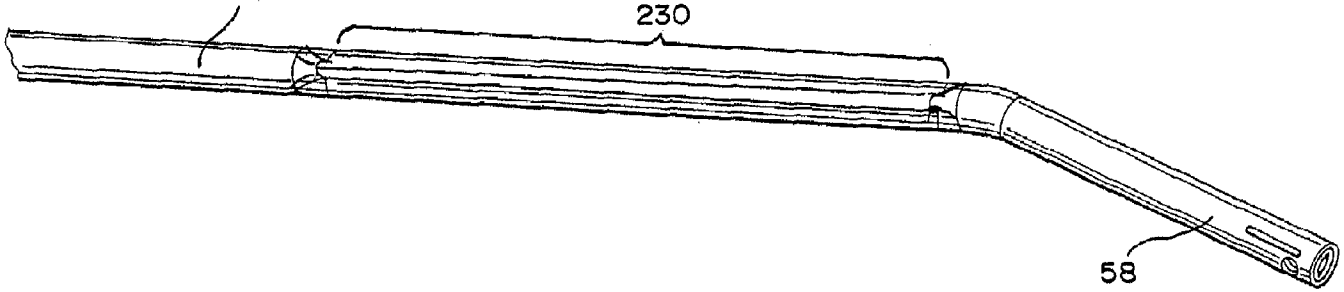
FIG. 19 is an alternative embodiment of an attenuator member.

In one embodiment, shown in FIG. 18, a trigger member 250 extends between and is connected to the side panels 54 on opposite sides of the first bay 18. Preferably, the trigger member 250 is configured as a ⅜ inch rod necked down to a ¼ inch diameter at the center thereof. The trigger member ensures that the first bay does not begin to collapse, i.e., the connector strap portions 144 are prevented from prematurely disengaging from the first bay side panels, until a predetermined load is reached. The trigger member 250 acts in tension to resist the outward bias force and movement created by the straps 144. Only when a predetermined desired force is exerted on the trigger member 250 does it break and release the side panels 54, thereby allowing the strap portions to disengage as explained below. The desired tension force can be achieved by providing a predetermined diameter of the trigger member. The trigger member 250 further provides the advantage of ensuring that the side panels on opposite sides of the first bay are released simultaneously.

In yet another embodiment, shown in FIGS. 14 and 17, the first ends 136 of the side panels of the first bay 18 are secured to the opposite sides of the first support member 26 using a connector 256 having a horizontally oriented central flange secured to the interior ridge 128 of the side panel with a plurality of fasteners or welds, and a vertical portion secured to the support member, for example with two fasteners. Referring to FIGS. 14, 17 and 32-34, the side panels 54 extend the length of the bay 18 and have opposite second ends 138 positioned adjacent the second support member 28 defining in part the first bay. First ends 142 of the side panels 54 of the second bay 20 are disposed laterally inward from the second ends 138 of the side panels 54 of the first bay 18 in an overlapping relationship. A rigid connector 260 (e.g., ¼ inch steel) connects the side panels 54 of the first and second bays 18, 20 to each other and to the support member 26 defining in part the first and second bays. The connector is substantially planar and includes a forwardly extending portion 262 secured to the interior ridge of the side panel of the first bay and a rearwardly extending portion 264 secured to the interior ridge of the side panel of the second bay. In this way, the connector is not intended to peel away from or become disengaged from the side panels of the first and second bays during a vehicle impact. Rather, the first bay, which is preferably configured with the horizontal and vertical crossing brace members, is maintained as a rigid sled for all impacts.

Figure 10:
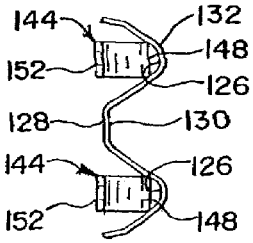
FIG. 10 is an end view of the side panel and first strap portions taken along line 10-109 of FIG. 7.
Figure 9:
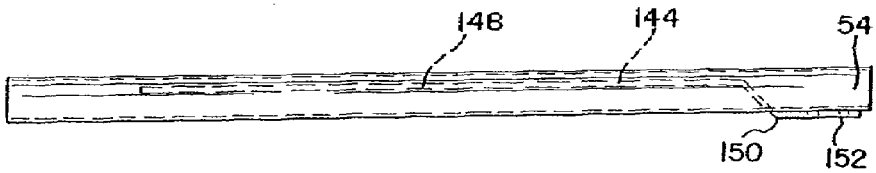
FIG. 9 is a top view of the side panel and first strap portions taken along line 9-9 of FIG. 7.

In one embodiment, shown in FIG. 7, the locations on the opposite sides of the elongated portions of the straps thereof are staggered to provide a lower constant level of attenuation. For example and without limitation, in one embodiment, the welds along the top side of the elongated portion overlie spaces between the welds along the bottom thereof. In one exemplary embodiment, the welds and spaces are each approximately one inch in length. In one embodiment, the welds are started the radius of the peel strap adjacent the side panel. The force required to peel the elongate portion can be adjusted or tuned by varying the length, size, and/or spacing of the welds. In one embodiment providing the greatest resistance, the welds are continuous along the top and bottom of the elongated portion. In one embodiment, the elongated portion 148 has a trapezoidal shape, with the height of the elongated portion decreasing from the rear to the front thereof. As can be seen in FIGS. 9 and 10, the elongated portions 148 disposed in and welded to the interior valleys 126 forms a box beam, which provides increased torsional and bending stiffness to the side panels 54.

Figures 21, 22:
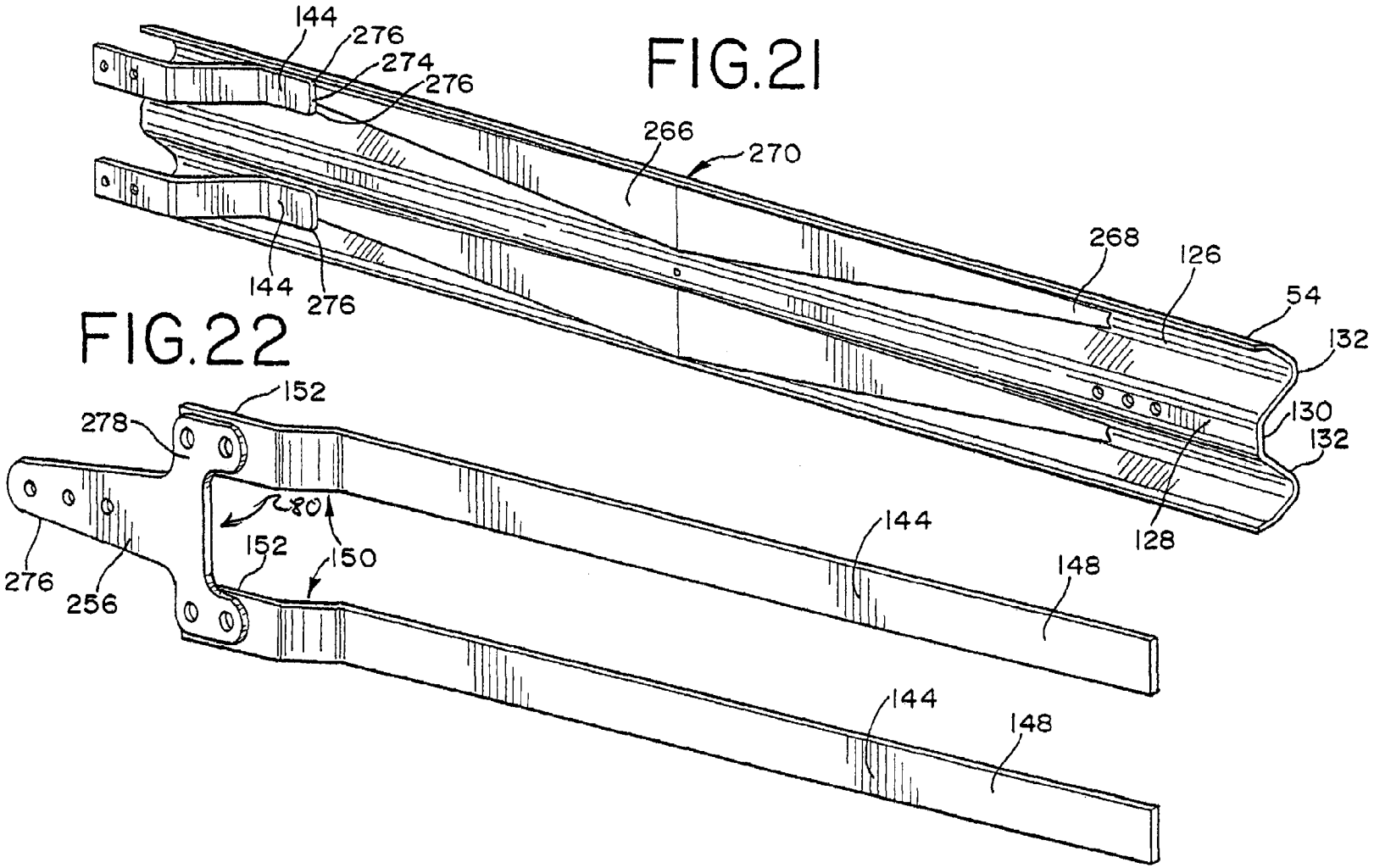
FIG. 21 is an alternative embodiment of a side panel assembly.
FIG. 22 is an alternative embodiment of a peel strap assembly.
Figure 23:
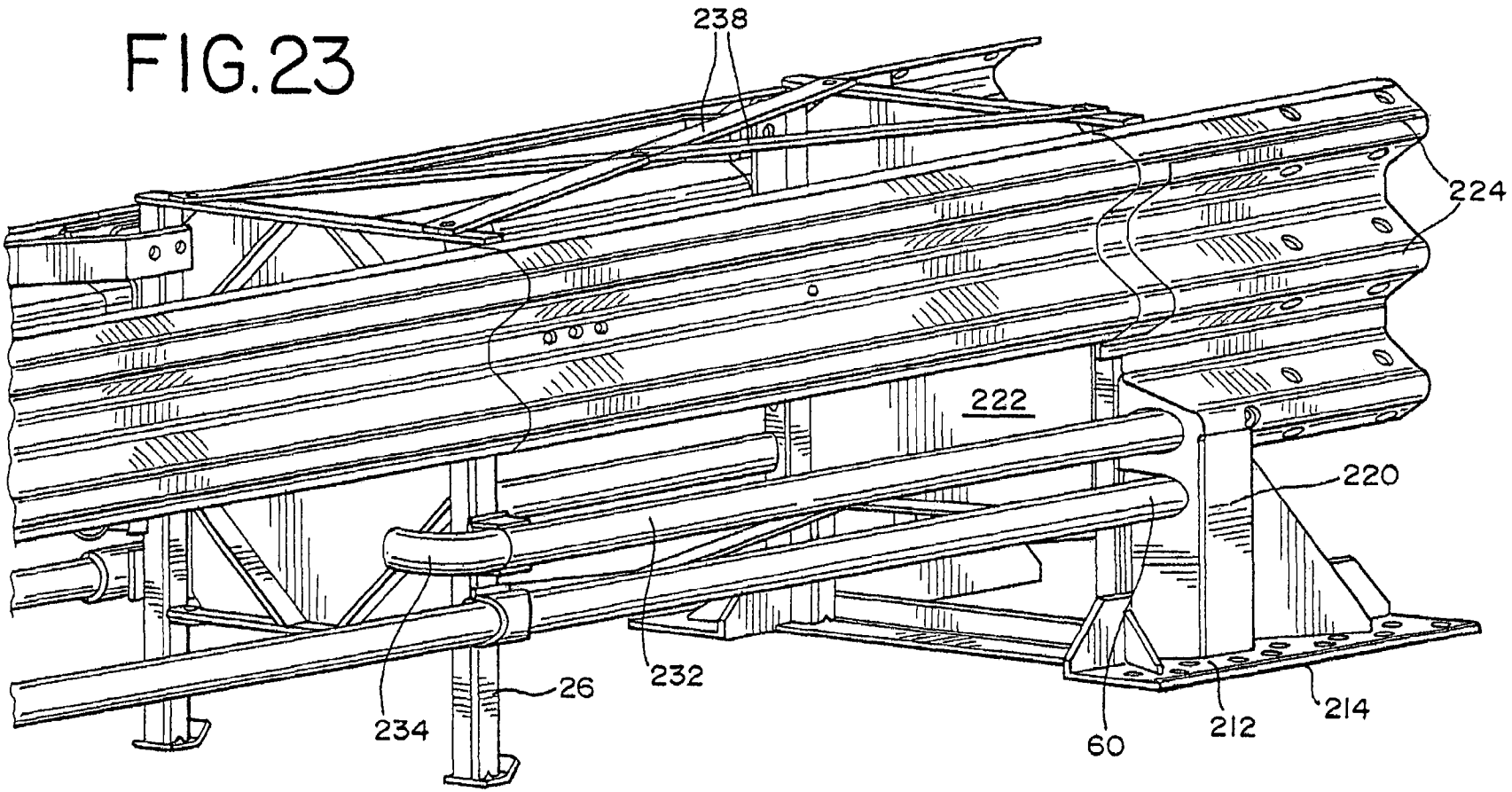
FIG. 23 is an enlarged side perspective view of the rear bay of the crash barrier shown in FIG. 14.

Referring to FIGS. 21, 34 and 39, reinforcing straps 266 are secured to the interior valleys. The height of the straps is the greatest in the middle 270 of the side panel and decreases toward the ends 268 thereof, with the straps nesting further in the valleys as the height decreases. The reinforcing straps 266 increase the bending and torsional stiffness, as noted above. In addition, the end 274 of the connector straps 144, which preferably have curved corners 276, overlap the ends of the reinforcing straps and are welded thereto. The curved corners 276 prevent the ends of the peel straps from digging into the side panel as the panel moves rearward, and peels the connecting straps from the side panel. In addition, the ends of the peel straps nest in the interior valley 126 over the reinforcing strap 266, thereby preventing binding between the peel strap and reinforcing strap as the barrier collapses and preventing snagging.

Referring to FIGS. 8-10 and 34, the connector 146 further includes a T-shaped second strap portion 154 having a horizontal portion 156 and a vertical portion 158. The horizontal portion 154 is disposed adjacent to and connected to the interior ridge 128 of the end 142 of the side panel 26 defining in part the second bay 20. The horizontal portion 154 is secured to the side panel 26 with a plurality of fasteners (shown as four). Upper and lower portions 160, 162 of the vertical portion 158 of the second strap portion are connected respectively to the end portions 152 of the first strap portions, for example with a pair of fasteners. In addition, the fasteners connect the first strap portion 144 and the second strap portion 154 to the support member 20 at the rearward holes of the vertical portion.

Connector members 146 having a similar construction connect the side panels 54 defining in part the second bay 20 and side panels 54 defining in part the third bay 22. Likewise, strap members 144 connect the side panels 54 defining in part the third bay 22 and the transition members 24 positioned rearwardly of the third bay 22 and/or the backup structure.

The length and properties of the strap members 144, 446 can be varied to provide different impact strengths for the first, second and third bays 18, 20, 22 and in particular the elongated portions 148, respectively. For example, the first strap portions 144 of the connector member in the second bay 20 are preferably the shortest, with attachment strengths lower than those in the other two bays, and thereby have the least impact strength. Other connector embodiments are disclosed in U.S. Pat. No. 5,022,782, which is hereby incorporated herein by reference. As shown in FIGS. 14, 22, 23, 27 and 34, the end portions 152 are offset a greater distance in the second bay 318, 20 than the ends portions of the other connector straps. In particular, the end portions are secured to an interior side of the side frames 32, 34 so as to provide a greater offset or eccentricity of the connector strap. In one embodiment, the offset is approximately 2⅜ inches between the exterior surface of the end portion 152 and the interior surface of the interior ridge 128. In this way, the straps have a lower onset of bending and subsequent peeling away from the associated side panel. In other bays, the interior surface of the end portion 152 is substantially flush (within ⅛ inch) with the interior surface of the interior ridge 128, thereby providing a lesser offset and greater required impact to initiate the onset of peeling.

Referring to FIGS. 21, 22 and 34, in one alternative embodiment, the T-shaped strap portion 256 has a horizontal portion 276 and a vertical portion 278. The horizontal portion is disposed adjacent to and connected to the interior ridge 128 of the end 142 of the side panel 54 defining in part the second bay 20. The horizontal portion is secured to the side panel 26 with a plurality of fasteners (shown as four). In this embodiment, however, a portion of the vertical portion is cut out or provided with a relief 280, such that it forms a Y-shaped connector variation of a T-shaped connector. The relief 280 reduces the binding of the system and the prying action of the rearwardly positioned side panel as the front side panel collapses rearwardly and is moved relative to the rearwardly positioned side panel. In this way, the side panel is allowed to more freely pivot about a vertical axis relative to the support member.

It should be understood that the straps can be made of a single material, such as steel plate, or can be made of a laminate structure, for example including several substrates to reduce the initial deformation forces.

Referring to FIG. 14, panel bridge members 284 extend between the side panels in the second and third bays proximate a longitudinal midpoint of the respective side panels 54. The bridge members 284 act as a compression member and in essence double the lateral stiffness of a respective side panels during a side impact. The bridge members have locator pins extending laterally from opposite ends thereof. The locator pins are positioned in holes formed in the respective side panels. During an axial impact, the side panels move laterally outwardly relative to each other, allowing the bridge members to simply fall out of the openings. The bridge members can be tethered to one or the other of the side panels.

Figure 29:
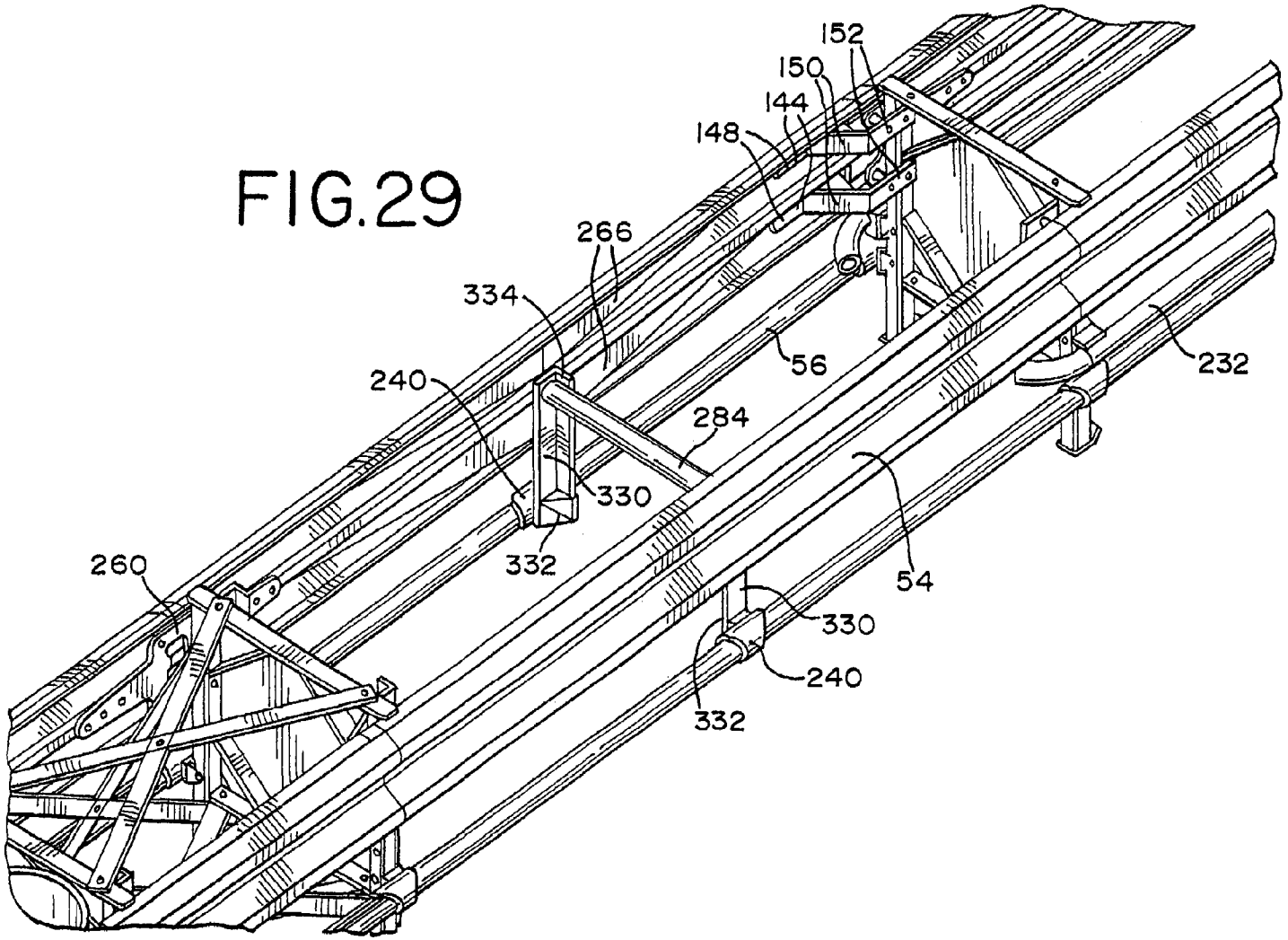
FIG. 29 is a partial perspective view of one embodiment of a vehicle crash barrier having a bridge assembly.

Referring to FIGS. 29 and 34, a brace or bridge assembly includes a pair of vertical uprights 330 having a lower end 332 connected to a guide member 240. The uprights further include an upper end 334 having openings or holes shaped to receive the locator pins of the bridge members 284. The bridge members are fixedly secured to the uprights such that the bridge members are not released when the pins as the side panels move laterally outward during an axial impact. Instead, the bridge members with the uprights and guide members are carried along the attenuator tube as they are impacted by an upstream support member. The uprights and guide members also help support the attenuator tube in a vertical direction at a location intermediate the support members as the uprights are supported by the side panels by way of the bridge member pins.

Referring to FIG. 1, the bottom 164 of the side panels 54 are vertically spaced above the ground and the bottom support surface 84 of the support members so as to form a gap therebetween. In one embodiment, the bottom of the side panels is approximately 20 inches above the ground. The side panels 54 provide an outer impact surface 166 that is exposed to a vehicle in a lateral impact. Likewise, the attenuator members 56 are disposed beneath the side panels 54 and have an outer impact surface 168 that is exposed to the vehicle. The attenuator members 56 in this way act as rub rails and prevent a tire or other component of the vehicle from becoming wedged beneath the side panel. The attenuator member is positioned approximately midway between the bottom 164 of the side panel and the bottom support surface 44 or ground, for example in one embodiment approximately 10 inches above the ground. In one embodiment, the attenuator member is offset by ⅝ inches.

As can be seen in FIG. 1, the simple construction of the crash cushion, wherein the energy absorbing members (attenuator member 56, side panels 54 and connectors 146) also provide redirecting capabilities, allows for the system to be made relatively "open." This construction avoids debris from being trapped in or beneath the structure by allowing the debris to pass therethrough. At the same time, the structure provides an aesthetically pleasing appearance.

Figure 11:
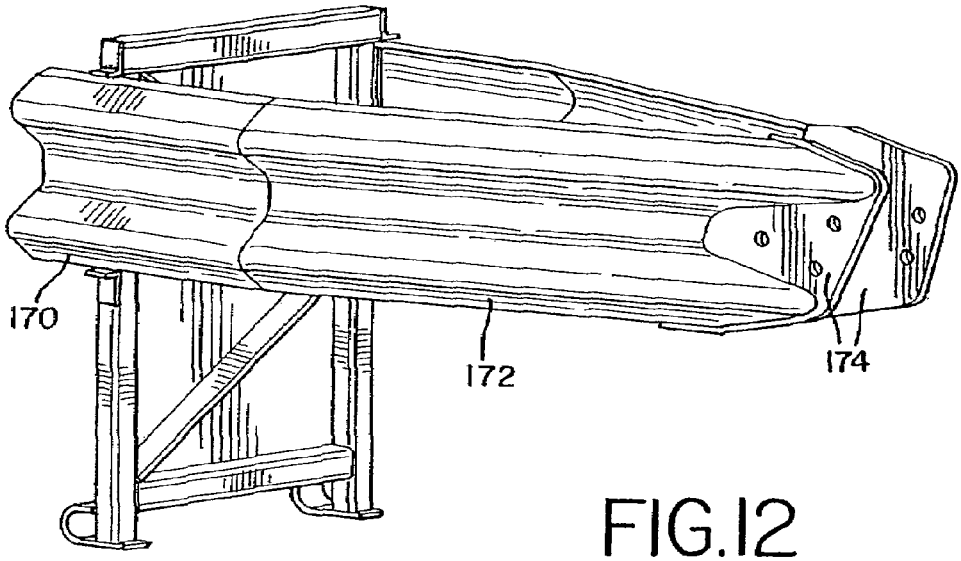
FIG. 11 is a rear perspective view of a transition assembly.

Referring to FIGS. 1 and 11, the transition structure 24 includes opposite pairs of first W-beam sections 170, second W-beam sections 172 tapered inwardly from the first sections and having an end plate 174. The end plate is configured to be secured to the hazard, such as a concrete barrier. A pair of brace structures 176 extend inwardly from the first sections and are also secured or engaged with the hazard. Other transition structures can be configured to transition from the side panels to other W-beam and thrie beam structures, bridge piers, sign posts or directly to the ground.

Figure 24:
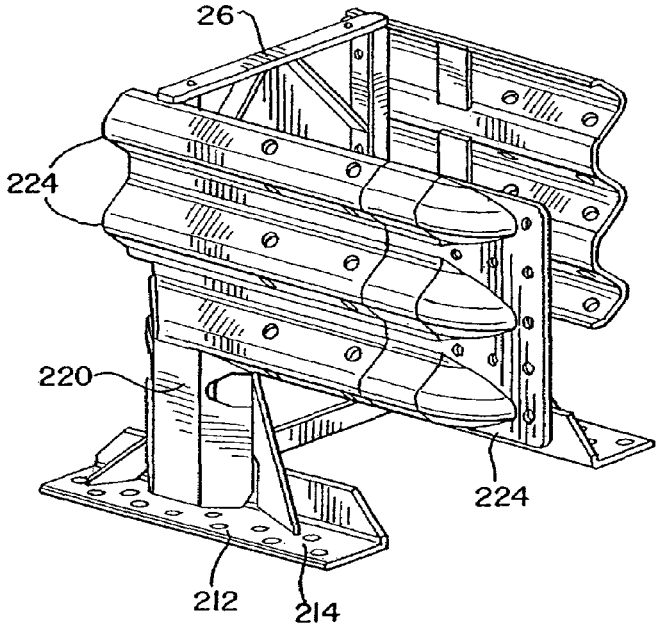
FIG. 24 is a perspective view of a backup structure with a first embodiment of a transition assembly.
Figure 25:
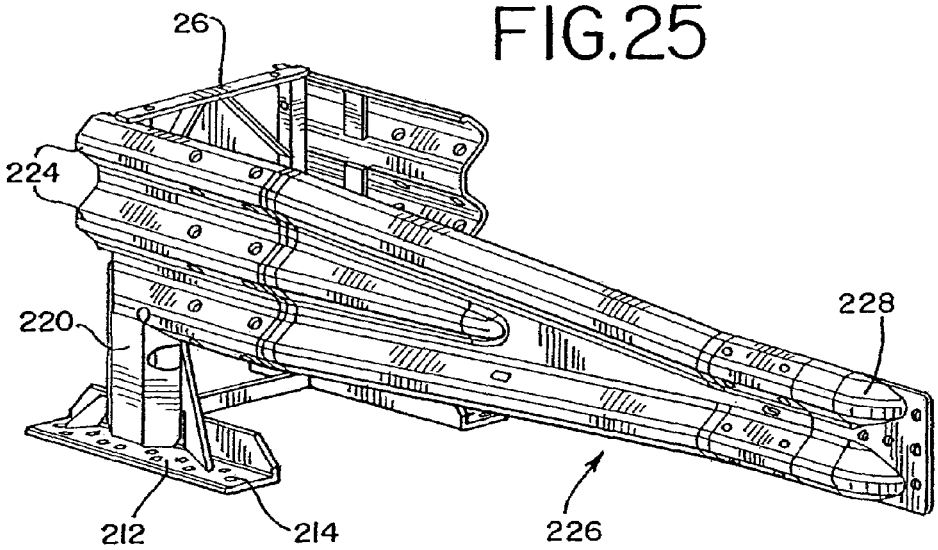
FIG. 25 is a perspective view of the backup structure shown in FIG. 24 with an alternative embodiment of a transition assembly.

As shown in the embodiments of FIGS. 24 and 25, various transition structures 224, 226 are mounted to the backup thrie-beams 216 to transition to the roadside hazards or other barriers, for example using various end shoes. The backup structure can straddle a 24 inch wide hazard, which reduces the overall length of the system.

Figure 38:
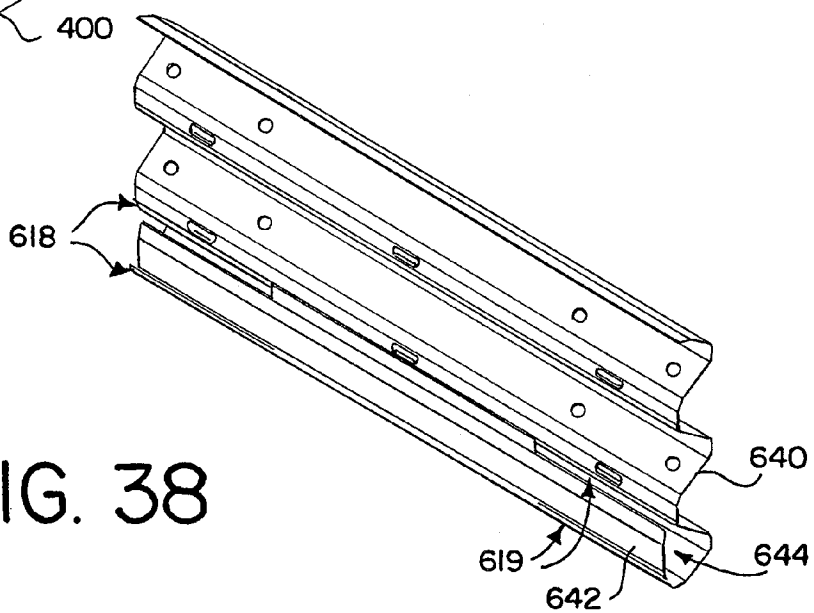
FIG. 38 is an interior perspective view of a transition panel.

Referring to FIG. 38, a transition panel 640 can be secured to a rear of each of the back-up structure side panels 216. The transition panel 640 includes as a conventional thrie-beam side panel. However, the lowermost valley is covered by a cover panel 642 so as to form a tunnel or enclosure 644. The panel 642 helps direct an attenuator tube 232 and helps prevent the tube from snagging on guardrail posts and/or other hardware that may be used to support and form the back-up structure, such as conventional guardrails, as the tube is moved within the tunnel 644. Four slots 619 are formed between the cover panel 642 and the underlying panel 640 at the front and rear ends along the top and bottom thereof. The slots 619 are open to the front and rear, thereby permitting another side panel to be slid into the slots and nest against the panel 642.

In one embodiment, shown in FIG. 15, the nose 4 is formed from a bumper frame structure 288 covered with a skin 290, formed for example from sheet metal. The frame structure includes a pair of attenuator members 292, formed as tubes, that move through deforming members 100 mounted on the support structure 26 to dissipate energy. A horizontal stabilizer sheet 294 extends between the opposite attenuator tubes 292. As the nose is impacted and the attenuator tubes 292 move through the deforming members 100, the sheet 294 is peeled away from the tubes. The sheet 294 stabilizes the collapse of the nose during angled impacts.

In another embodiment, shown in FIG. 14, the nose is formed from a plurality (shown as 7) of sheet metal tubes 296 joined in a cluster. The tubes (preferably 12 inches in diameter) are preferably made from ⅛ inch thick by 18 inch long steel. The tubes flatten upon impact. The cluster or array of tubes is surrounded by a peripheral sheet metal skin 298. As the cluster and skin flatten out, they provide a wide bearing surface for the impacting vehicle and better redistribute the impact load to the two sides of the crash barrier.

Figures 26, 27:
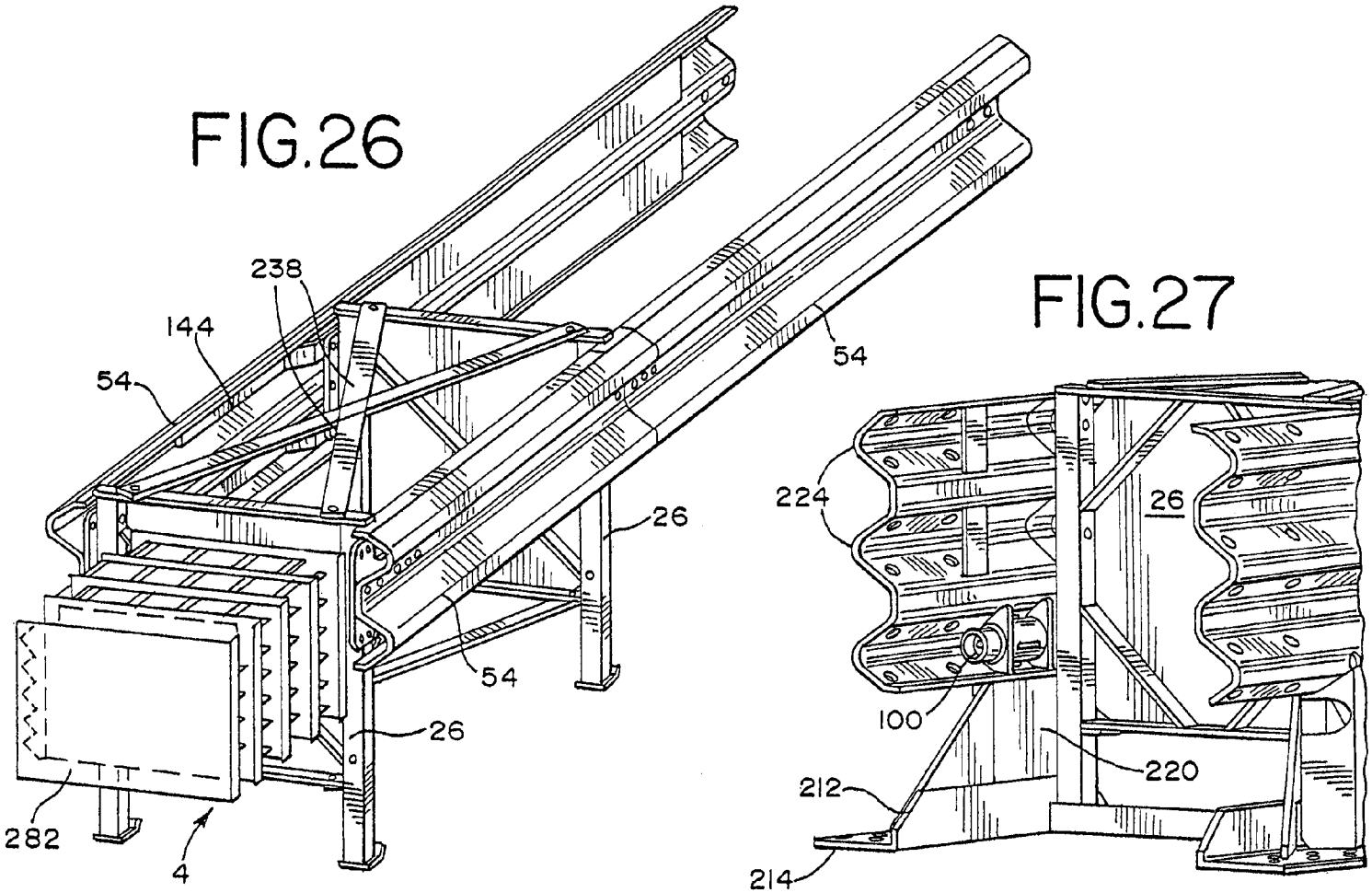
FIG. 26 is a front prospective view of an alternative embodiment of a nose.
FIG. 27 is a rear perspective view of the backup structure with a deforming member secured thereto.

In another embodiment shown in FIG. 26, the nose is formed from a plurality of crushable honeycomb structures 282 extending forwardly from the first bay. As mentioned above, in one embodiment shown in FIGS. 32-34, the nose is configured simply as a thin sheet metal cover, which covers and is attached to the trigger lever arm.

With reference to FIGS. 1, 14, 28, 32-34 and 39, in operation, and during an axial impact, a vehicle impacts the nose 4 of the crash cushion, which initially collapses. Next, end terminals secured to the front ends 136 of the side panels 54 of the first bay 18, 416 are engaged and move the forwardmost support member 26 rearwardly. In addition, the vehicle contacts the forwardmost support member directly by way of the collapsed nose. As the first support member 26, 426 and the first bay 18, 416 are impacted, a compression force is applied to the overall crash cushion. Accordingly, the energy absorbing structures of the first, second and third bays began to react. Since the energy absorbing structure, including the shorter strap portion 144, of the second bay is the weakest, the second bay 20 collapses first, with the elongated portions 148 of the first strap portions 144 peeling away from the side panels 26 in the second bays 20, 318 with the side panels of the second bay telescoping past the third bay. The strap portions of the second bay begin to fail first by virtue of the greater offset (eccentricity) of the end portion relative to the elongated portion. At the same time, the deforming member 100 is pulled by the first support member 26, along the attenuator member 56. In the embodiment of FIG. 39, straps 446 do not dissipate as much energy since no welds or fasteners are peeled or failed. Rather, the straps 446 dissipate energy by bending, the direction of which is controlled by fasteners 478.

Figure 12:
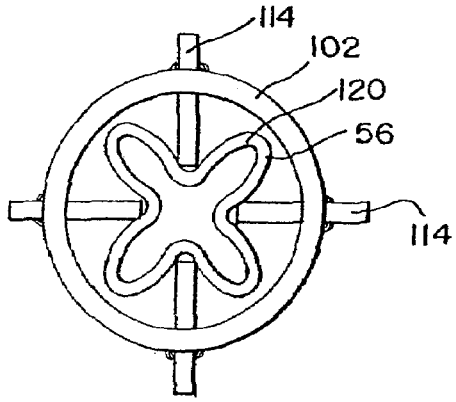
FIG. 12 is an end view of a deforming member and an attenuator member.
Figure 13:
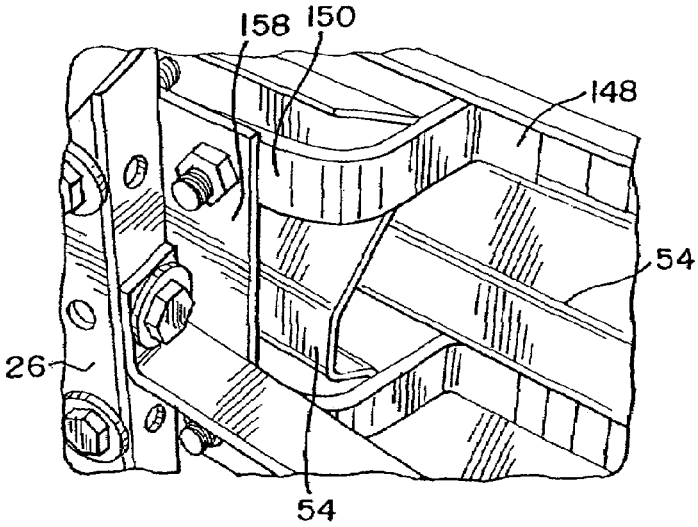
FIG. 13 is a perspective view of a partially deformed connector joining adjacent side panels.

Alternatively, as shown in FIGS. 14, 28 and 39-40, the deforming members initially do not engage the attenuator member due to the crimped shape of the attenuator tube over the initial stage 230. As the deforming member 100 engages the attenuator member 56, the impact surfaces 120 deform the attenuator member 56, as shown in FIG. 12, and dissipate energy. Preferably, the impact surfaces 120 merely bend and deform the attenuator member 56 so as to maintain the tensile strength capabilities thereof, rather than severing or cutting it, although such shearing action can also be employed. In various embodiments, a pair of deforming members engaging a pair of attenuator members provide a baseline attenuation of between about 1,000 lbf and about 75,000 lbf over a distance of travel, more preferably greater than about 10,000 lbf, more preferably greater than about 20,000 lbf, more preferably between about 10,000 lbf and about 50,000 lbf, and more preferably between about 30,000 lbf and about 40,000 lbf.

After the second bay 20 is collapsed, the elongated portions 148 of the first strap portions 144 of the connector member in the third bay 22 peel away from the side panels 54 in the third bay, with the side panels telescoping past the hazard. Again, the in the embodiment of FIG. 39, the straps 446 are not peeled away, but rather remain attached and prevent the flaring of the side panels 54. Since, in FIGS. 14 and 28, the strap portions in the third bay are relatively longer than the strap portions in the second bay, and are preferably connected with a greater number of welds or other fastening connections, the strap portions are peeled away from the side panels at a greater load level than the strap portions of the second bay. At the same time, the deforming member 100 continues to deform the attenuator member 56. After the final bay 22 is collapsed, the elongated portion 148 of the first strap portion peels away from the side panel in the first bay 18. At the same time, the deforming member 100 continues to deform the attenuator member 56. During this entire sequence, the first bay 18 as shown in FIG. 1, with its brace member 134 and stiff connector peel straps, acts as a sled (the bending strength of which resists rocking of the support members and the mass of which further minimizes the stopping distance of lighter weight vehicles). In one embodiment, the first bay is designed to collapse only at the end of an impact from the heaviest vehicle. In addition, the shorter, stiffer first and third bays in the front and rear help reduce the risk of pocketing, for example at the rear area adjacent a fixed barrier. During a total collapse of the crash cushion, the side panels may telescope past the hazard, for example up to ten (10) feet. During the collapse, the deforming members 100 and attenuators 56 provided a baseline attenuation, while also guiding the support members 26.

Since the force from the attenuators is applied near ground level the impacting energy is absorbed near ground level, the anchors 62 primarily experience a shear force, rather than a lifting or pull-out force normal to the ground. In addition, since the attenuator member 56 also acts as a tension member, anchors are needed only at the two ends of the system. Depending on the weight of the impacting vehicle, ½ to ¾ or more of the impacting energy may be absorbed by the attenuators.

Alternatively, as shown in FIGS. 14, 32-34 and 39, the first bay does not collapse at all. Rather, after the nose 4 collapses, the tension strap 202 releases. In addition, the attenuator member 56 does not initially absorb any energy during an initial phase of the impact due to the crimping or performing of the tube. Accordingly, when impacted by a smaller vehicle, the weight of the first bay 18, acting as a sled, in combination with release of the tension strap 202 and the connector straps 144, 446 of the second bay and the collapse of the nose portion, absorb the energy during the initial delta V. Subsequently, after a predetermined length of travel or passage of time, the deforming members 100 secured to the first bay engage the attenuator tube 56 and travel with the first bay. Next, the first bay 18 contacts the third bay 22 and the connector straps 144 in the third bay 22 disengage while the additional attenuator member 232 connected to the third/fourth bay is forced through the deforming members 100 secured to the backup structure 212. In one embodiment, the attenuator member is moved rearwardly in the tunnel 644 formed by the transition member as shown in FIG. 38. The attenuator member 232 can be precrimped or shaped along an initial portion to absorb different amounts of energy as the deforming member is moved therealong.

In other embodiments, the system is provided with additional bays. For example, the length of the system can be divided into four bays, a first rigid bay 136, and three collapsible bays 318, 320, 322 as shown in FIG. 28, or bays 416, 418, 420, and 422 as shown in FIG. 39. The attenuator members and peel straps can be tuned such that the three collapsible bays collapse in a predetermined sequence, for example successively, or with the intermediate bay going first, followed by the first and then last bay, or vice versa, or with the first collapsible bay 318 going first followed by the second and third collapsible bays 320, 322, successively or simultaneously.

In operation, and during a lateral impact, the connectors 146 and in particular the strap portions 144, 154 are put in tension. In addition, the tension strap 202 can be used to increase the initial overall tension of the system and thereby increase the lateral stiffness of the crash cushion. Due to the offset (lateral) eccentricity of the first and second strap portions 144, 154, the connectors 146 pull the adjacent, connected side panels 54 together and work to close any lateral gap therebetween. In this way, the connectors 146 and side panels 54 reduce the likelihood that a vehicle traveling in the opposite direction 12 will spear the rear end of a side panel during a lateral impact, thereby providing a bi-directional crash cushion without the need to overlap the side panels in the opposite direction on opposite sides of the crash cushion. As such, the system does not need to be reconfigured when being moved from a unidirectional site to a bidirectional site. In addition, during lateral impact, the attenuator member 56, which is in tension between the front and rear anchors, restrains the system and helps prevent it from lateral and overturning movement during a lateral impact.

The overall system can be assembled offsite and transported fully assembled as a single unit to a job site. The system can be configured with hooks (not shown) for lifting. Once positioned adjacent a hazard, the anchors 62, 80 and/or backup structure can function as templates for drilling holes for the anchor bolts.

Referring to FIG. 39, the crash cushion can be easily converted to provide different energy absorbing capabilities by removing or adding one or more bays, in essence making the system modular. For example, in one embodiment, the crash cushion has a first rigid bay 416 and two collapsible bays 418, 420. The last bay may or may not include an auxiliary attenuator member 232. For example, a three bay 416, 418, 420 crash cushion having a nose (two feet), a first rigid bay (3 feet), and two collapsible bays 418, 420 (six feet each) (17 feet total) can be configured to satisfy the 80 kph CEN (EN-1317) test conditions and the 70 kph NCHRP 350 test, as well as 100 kph light car conditions. In addition, by adding a fourth bay 422 with a two-staged auxiliary attenuator 232, having an initial preshaped portion (e.g., 2 feet) and a final portion (e.g., 4 feet), the crash cushion (23 feet total) can be configured to satisfy the 100 kph and 110 kph CEN (EN-1317) test conditions and the 100 kph NCHRP 350 test requirements. In essence, the system is dual compliant in terms of meeting the NCHRP and CEN test requirements for the United States and Europe respectively.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A crash cushion comprising:

a deformable tube extending in a longitudinal direction and having a first length defined between first and second ends, wherein a portion of said tube is at least partially filled with a secondary component, wherein said portion of said tube filled with said secondary component has a greater deformation strength than unfilled portions of said tube, wherein said portion of said tube filled with said secondary component has a second length less than said first length; and a deforming member moveable relative to said deformable tube in said longitudinal direction between at least a first and second position, wherein said deforming member deforms said deformable tube as said deforming member and said deformable tube are moved relative to each other between said first and second positions.

2. The crash cushion of claim 1 wherein said deforming member comprises a housing surrounding said deformable tube.

3. The crash cushion of claim 1 wherein said deforming member comprises an impingement member comprising a contact surface having an initial contact portion and a maximum contact portion, wherein said maximum contact portion impinges a greater amount on said deformable member than does said initial contact portion.

4. The crash cushion of claim 1 wherein said secondary component comprises a tube.

5. The crash cushion of claim 1 wherein said secondary component comprises a material selected from the group consisting of rubber, water, plastic, sand, polyurethane foam.

6. The crash cushion of claim 4 wherein said deformable tube and said secondary component tube are each formed of metal.

7. An energy absorbing vehicle barrier comprising:

a deformable tube having a first length defined between first and second ends, wherein a portion of said deformable tube is at least partially filled with a secondary component, wherein said portion of said tube filled with said secondary component has a greater deformation strength than unfilled portions of said tube, wherein said portion of said tube filled with said secondary component has a second length less than said first length; and a deforming member engageable with said deformable tube, wherein one of said deforming member and said deformable tube are moveable relative to the other of said deforming member and said deformable tube between at least a first and second position, wherein said deforming member deforms said deformable tube as said one of said deforming member and said deformable tube is moved relative to said other of said deforming member and said deformable tube between said first and second positions.

8. The energy absorbing vehicle barrier of claim 7 wherein said deforming member comprises a housing surrounding said deformable tube.

9. The energy absorbing vehicle barrier of claim 7 wherein said deforming member comprises an impingement member comprising a contact surface having an initial contact portion and a maximum contact portion, wherein said maximum contact portion impinges a greater amount on said deformable member than does said initial contact portion.

10. The energy absorbing vehicle barrier of claim 7 wherein said secondary component comprises a tube.

11. The energy absorbing vehicle barrier of claim 10 wherein said deformable tube and said secondary component tube are each formed of metal.

12. The energy absorbing vehicle barrier of claim 7 wherein said secondary component comprises a material selected from the group consisting of rubber, water, plastic, sand, polyurethane foam.

13. The energy absorbing vehicle barrier of claim 7 wherein said deforming member is moveable relative to said deformable tube.

14. The energy absorbing vehicle barrier of claim 7 wherein said deformable tube is moveable relative to said deforming member.

15. An energy absorbing vehicle barrier comprising:

a first tube having a first length;

a second tube disposed within said first tube, said second tube having a second length less than said first length; and a deforming member engageable with said first tube, wherein one of said deforming member and said first tube are moveable relative to the other of said deforming member and said first tube between at least a first and second position, wherein said deforming member deforms said first tube as said one of said deforming member and said first tube is moved relative to said other of said deforming member and said first tube between said first and second positions.

16. The energy absorbing vehicle barrier of claim 15 wherein said deforming member comprises a housing surrounding said first tube.

17. The energy absorbing vehicle barrier of claim 15 wherein said deforming member comprises an impingement member comprising a contact surface having an initial contact portion and a maximum contact portion, wherein said maximum contact portion impinges a greater amount on said first tube than does said initial contact portion.

18. The energy absorbing vehicle barrier of claim 15 wherein said first and second tubes are each formed of metal.

19. The energy absorbing vehicle barrier of claim 15 wherein said deforming member is moveable relative to said first tube.

20. The energy absorbing vehicle barrier of claim 15 wherein said first tube is moveable relative to said deforming member.

* * * * *